US007908687B2

(12) United States Patent
Ward et al.

(10) Patent No.: US 7,908,687 B2
(45) Date of Patent: Mar. 22, 2011

(54) DEVICE FOR TEMPERATURE CONDITIONING AN AIR SUPPLY

(75) Inventors: Barry Ward, Bradford (GB); David Barker, Rotherham (GB)

(73) Assignee: Morphy Richards Limited, Mexborough (GB)

( * ) Notice: Subject to any disclaimer, the term of this patent is extended or adjusted under 35 U.S.C. 154(b) by 0 days.

(21) Appl. No.: 12/224,081

(22) PCT Filed: Feb. 15, 2007

(86) PCT No.: PCT/GB2007/000502

§ 371 (c)(1),
(2), (4) Date: Jun. 7, 2010

(87) PCT Pub. No.: WO2007/093783

PCT Pub. Date: Aug. 23, 2007

(65) Prior Publication Data

US 2010/0235991 A1 Sep. 23, 2010

(30) Foreign Application Priority Data

Feb. 17, 2006 (GB) ..... 0603292.4

(51) Int. Cl.
*A47C 21/04* (2006.01)

(52) U.S. Cl. ..... 5/421; 5/423; 62/3.3

(58) Field of Classification Search ..... 5/421, 423; 165/61; 62/3.3, 3.5
See application file for complete search history.

(56) References Cited

U.S. PATENT DOCUMENTS 4,777,802 A * 10/1988 Feher ..... 62/3.3
5,448,788 A * 9/1995 Wu ..... 5/421
5,555,579 A * 9/1996 Wu ..... 5/421
6,006,524 A 12/1999 Park et al.

(Continued)

FOREIGN PATENT DOCUMENTS

BR 8805330 A 5/1990

(Continued)

OTHER PUBLICATIONS

Examination Report under Section 18(3) issued by the United Kingdom Intellectual Property Office in the priority Application No. GB 0603292.4, dated Jul. 28, 2008.

*Primary Examiner* — Michael Trettel
(74) *Attorney, Agent, or Firm* — Harness, Dickey & Pierce, P.L.C.

(57) ABSTRACT

A heating and cooling device for temperature conditioning an air supply for an air conditioned appliance, said heating/cooling device comprising: a first air passage for channeling a first air flow; a second air passage for channeling a second air flow; an inlet fan for drawing air into said first, air passage; an exhaust fan for drawing air through said second air passage; one or a plurality of heat exchangers for exchanging heat between air in said first air passage and air in said second exhaust air passage; wherein said first air passage comprises a tubular channel having an inlet at a first end and only one outlet, said outlet being at a second end of said passage, and said inlet fan is positioned at said inlet, such that said first air flow is channeled through said inlet fan, along the whole of said air passage, encountering all of said one or plurality of heat exchangers, and out of said outlet.

17 Claims, 19 Drawing Sheets

U.S. PATENT DOCUMENTS

| | | | | |
|---|---|---|---|---|
| 6,119,463 | A | 9/2000 | Bell | |
| 6,223,539 | B1 | 5/2001 | Bell | |
| 6,826,792 | B2 * | 12/2004 | Lin | 5/421 |
| 2004/0182087 | A1 | 9/2004 | Huang | |
| 2004/0187216 | A1 | 9/2004 | Lin | |
| 2010/0071130 | A1 * | 3/2010 | Frias | 5/421 |

FOREIGN PATENT DOCUMENTS

| | | | |
|---|---|---|---|
| DE | 102 21 375 | A1 | 11/2002 |
| DE | 203 13 149 | U1 | 3/2004 |
| JP | 10-132435 | A | 5/1998 |
| WO | WO 99/58907 | A | 11/1999 |
| WO | 02/058165 | A1 | 7/2002 |

* cited by examiner

Mattress Probe Layout

Peltier control on air mattress no modifications

Peltier control in cooling mode

Mattress used with quilt facing down level10

Mattress used with quilt facing up level 10

Heating Mode
Impervious material below mattress

Heating Mode
Impervious material below mattress and
lower ¾ of upper blanket

New inlet nozzle and impervious material below mattress

New inlet nozzle and impervious material below mattress

New inlet nozzle and impervious material below mattress and bottom 400mm of upper surface Temperature profile after all-night test Cooling Mode
New inlet nozzle and impervious material below mattress and bottom 400mm of upper surface Temperature profile after all-night test

DEVICE FOR TEMPERATURE CONDITIONING AN AIR SUPPLY

CROSS-REFERENCE TO RELATED APPLICATIONS

This application is a 371 U.S. National Stage of International Application No. PCT/GB2007/000502, filed Feb. 15, 2007. This application claims the benefit of British Patent Application No GB 0603292.4, filed Feb. 17, 2006. The disclosures of the above applications are incorporated herein by reference.

FIELD OF THE INVENTION

The present invention relates to a device for temperature conditioning an air supply, particularly although not exclusively, to an air mattress device.

BACKGROUND TO THE INVENTION

It is known to provide flexible webs of material having a plurality of tubular channels through which air can flow, so that heated or cooled air can pass along the air channels to provide a warmed or cooled pad of material. Such materials can be used in temperature controlled garments, temperature controlled seats for automotive use, and temperature controlled blankets or mattresses.

Typically, such temperature controllable materials may be formed from a thermo setting plastics material, having a plurality of relatively thicker fibers arranged in a first direction, crossed by a plurality of laterally undulating thinner fibers in a second direction both above and below the thicker fibres. Parallel to the thicker fibers in the first direction, may be provided a plurality of thermo setting fibers, such that when the thicker fibers in the first direction are bonded to the thinner fibers in a second direction and heat is applied, the thermo setting thinner fibers in the first direction contract, thereby pulling the thicker fibers into a series of vertical undulations, and forming a plurality of air channel between a sandwich of upper and lower relatively thinner fibers.

This hollow material can be covered with upper and lower layers of fabric to produce a hollow resilient pad which is comfortable to sit or lay on, and through which air can be passed. By temperature controlling the air, the pad can be heated up or cooled down.

However, the usability and acceptance by consumers of air temperature controllable materials has been held back by the size, weight, noise and inconvenience of air heating and cooling devices for use with temperature controllable fabrics. For example a known heating device for an air temperature controlled mattress has dimensions of the order 40 cm width, 80 cm length, and 50 cm height, which is an inconveniently sized air supply unit for a domestic use.

SUMMARY OF THE INVENTION

According to a first aspect there is provided a heating and cooling device for temperature conditioning an air supply for an air conditioned appliance, said heating/cooling device comprising a first air passage for channeling a first air flow; a second air passage for channeling a second air flow; an inlet fan for drawing air into said first, air passage; an exhaust fan for drawing air through said second air passage; one or a plurality of heat exchangers for exchanging heat between air in said first air passage and air in said second exhaust air passage; wherein said first air passage comprises a tubular channel having an inlet at a first end and only one outlet, said outlet being at a second end of said first air passage, and said inlet fan is positioned at said inlet, such that said first air flow is channeled through said inlet fan, along the whole of said first air passage, encountering all of said one or plurality of heat exchangers, and out of said outlet.

Preferably the device further comprises a ceramic heater device positioned in said first air passage in said first air flow, at a position downstream of said heat exchanger, so as to further heat said first air flow after heating by said one or plurality of heat exchangers, in a heating mode.

Said inlet fan may be positioned at an inlet of said first air passage way, for drawing air into said first air passage way and pushing air through said first passage way.

Preferably said device comprises a removable and replaceable inlet air filter for filtering air entering said first air passage.

Said replaceable filter may comprise a filter material suitable for removing allergens from said first air flow.

Said second air passage may comprise a tubular wall having a pair of air inlets, a first said inlet being at a first end of said tubular wall, and a second said inlet being positioned at a second end of said tubular wall, said tubular wall extending there between, and an outlet positioned in said tubular wall between said first and second inlets;

said one or a plurality of heat exchangers are positioned within said tubular wall, so that said second air flow passes through said one or plurality of heat exchangers; and said exhaust fan is positioned at said outlet such as to draw air through said first and second inlets of said second air passage, over said one or plurality of heat exchangers, and out of said outlet.

Said exhaust fan may be positioned at an outlet of said second passage way, so as to draw air through one or more inlets of said second passage way, and through said outlet of said second passage way.

A said heat exchanger may comprise:

a first heat sink extending into said first air passage, such that air flowing through said first air passage exchanges heat with said first heat sink;

a second heat sink extending into said second air passage, such that air flowing in said second air passage exchanges heat with said second heat sink; and one or a plurality of electrically driven Peltier effect heat pump devices, positioned between said first and second heat sinks, said Peltier effect devices capable of pumping heat in a first direction from said first heat sink to said second heat sink in a cooling mode, for cooling air in said first passage, and capable of pumping heat from said second heat sink to said first heat sink for heating said air in said first passage, in a heating mode.

Said heat exchanger device may comprise:

a first set of heat sink devices positioned in said first air passage;

a second set of heat sink devices positioned in said second air passage; and a plurality of electric heat pump devices positioned between said first and second heat sinks for transferring heat between said first and second sets of heat sinks.

Preferably, a said heat pump device comprises one or a plurality of Peltier effect devices.

The heating and cooling device is preferably suitable for supplying temperature conditioned air to an air mattress having a plurality of air passages designed for flow of air there through.

In one embodiment the device may be capable of supplying temperature conditioned air to a double divan size air mattress such that upon initiating a heating mode, a temperature at a surface of said air mattress increases over a five to fifteen degrees centigrade range over a period of 12 minutes.

The heating and cooling device may be capable of supplying temperature conditioned air to a double divan size air mattress such that in a cooling mode, a surface temperature of said air mattress reaches a temperature of between two and four degrees below ambient external air temperature.

The heating and cooling device may be capable of supplying temperature conditioned air to a double divan size air mattress such that in a cooling mode, after a five hour period from initiating said cooling mode, an air temperature of said air mattress is in the range of between two and three degrees below ambient external air temperature.

The heating and cooling device may have overall external dimensions in the ranges width 15 cm to 36 cm: height 7 cm to 15 cm; length 20 cm to 40 cm.

Said first air passage may have an internal cross sectional area in a direction perpendicular to a main direction of air flow, in the range 30 $cm^2$, to 120 $cm^2$.

Said second air passage may have an internal cross sectional area in a direction perpendicular to a main direction of air flow, in the range 30 $cm^2$, to 108 $cm^2$.

A said heat exchanger may comprise:

an upper heat sink comprising a plurality of fins extending along a main length of said first passage; and a second heat sink comprising a plurality of elongate fins extending along a length of said second air passage;

for Peltier effect heat pump devices, each having an active upper surface area in the range 25 to 45 mm×25 to 45 mm, and having a second active area of dimensions in the range 25 to 40 mm×25 to 40 mm.

The heating and cooling device may be suitable for use in combination with an air mattress, said air mattress comprising a plurality of fibres forming a plurality of generally parallel tubes arranged side by side, said plurality of fibres having air gaps there between, for allowing exit of air passing through said plurality of tubes, such that said air is released over substantially a whole upper surface of said air mattress.

According to a second aspect there is provided a temperature conditioning device for heating or cooling an air supply for an appliance, said device comprising:

a heat exchanger having a first heat sink and a second heat sink, said first and second heat sinks being placed opposite each other and separated from each other by one or a plurality of electrically operable heat pumps;

a first air passage for supplying temperature conditioned air to an outlet of said device;

a second air passage for channeling a flow of ambient air drawn in from outside of said device to said heat exchanger device;

said first heat sink being arranged in said first air passage for transfer of heat between said first heat sink and a temperature conditioned airflow in said first air passage;

said second heat sink being positioned in said second air passage, for transfer of heat between said second heat sink and said ambient air flow, wherein said heat exchanger is operable for transferring heat between said first air flow in said first air passage, and said air flow in said second passage.

Said device may further comprise a first air fan for urging said conditioned airflow through said first heat sink, and toward said outlet.

Said device may further comprise a second air fan for urging said second air flow though said second air passage and through said second heat sink.

Preferably, said device further comprises a removable filter for filtering air in said first air passage.

Preferably, said filter is resiliently biased and ejectable from said casing by pushing the filter.

Preferably said first filter is positioned in said first air flow, immediately before said first air fan, for filtering air in said first air passage.

Preferably said first air fan is mounted within a substantially circular air chamber forming part of said first air passage.

Exhaust air in said second air channel may be drawn in through a first set of one or more grills by a said fan device, passes through a waste heat sink, and is expelled out of a second grill.

In a twin module unit, the device may comprise a first heating/cooling module and a second heating/cooling module, said first and second modules being provided in and sharing a same casing.

For the twin module unit in the best mode, the casing has external dimensions in the ranges: length—810 mm to 840 mm; width—110 mm to 130 mm; height—150 mm to 170 mm.

For the twin module embodiment each of said first and second heating/cooling modules are independently and separately controllable to provide first and second independently controllable temperature conditioned air flows.

In a single module device in the best mode, the casing may have external dimensions in the ranges: length—120 mm to 160 mm; width—110 mm to 130 mm; height—150 mm to 170 mm.

Preferably the device is remote controllable, having a handheld remote control device and a transmitter/receiver, for remotely controlling a temperature and flow rate of a said conditioned air flow.

The device may further comprise a stand alone separate power supply for converting mains voltage electricity to a lower voltage electricity below mains voltage.

Preferably said casing comprises an elongate tube like structure, having a plurality of air inlets and outlets on a first side, and having a second side which is continuous and devoid of any air inlet/outlet grills, upon which the device may be stood on a floor. This may enable the device to be placed in a plurality of orientations and allow flexibility in positioning the device adjacent a bed.

Preferably said substantially tubular casing is substantially rectangular in cross section.

Preferably, said elongate tubular casing is divided into a plurality of air passages, by a plurality of bulk heads which extend across a width of said tubular casing.

The device may further comprise a flexible and extendible hose through which air can be pumped, a said air outlet and allowing said device to be placed underneath said mattress in use on a bed.

Said flexible air hose comprises an extension which enables the heating and cooling device to be moved between a first orientation in which a face of said device containing a plurality of air inlets and outlets is positioned facing upwardly, and a second orientation in which said face is positioned facing substantially horizontally.

According to a fourth aspect there is provided a temperature conditioning device for heating or cooling an air supply for a bed heating and cooling mattress, said device comprising:

an external casing; and a plurality of air conditioning modules, each said module comprising:

a heat exchanger having a first heat sink and a second heat sink, said first and second heat sinks being placed opposite each other and separated from each other by one or a plurality of electrically operable heat pumps;

a first air passage for supplying temperature conditioned air to an outlet of said device;

a second air passage for channeling a flow of ambient air drawn in from outside of said device to said heat exchanger device;

said first heat sink being arranged in said first air passage for transfer of heat between said first heat sink and a temperature conditioned airflow in said first air passage;

said second heat sink being positioned in said second air passage, for transfer of heat between said second heat sink and said ambient air flow, wherein said heat exchanger is operable for transferring heat between said first air flow in said first air passage, and said air flow in said second passage, wherein said plurality of air conditioning modules are arranged in said casing such that a plurality of air inlets for ambient air drawn into and expelled from said device are all positioned on a first face of said device, and a plurality of air outlets for temperature conditioned air are positioned on a second face of said casing.

Each of said heating/cooling modules may be independently and separately controllable to provide first and second independently controllable temperature conditioned air flows.

The device may further comprise a handheld remote control device and a transmitter/receiver, for remotely controlling a temperature and flow rate of a said conditioned air flow.

According to a fifth aspect there is provided a bed warmer for providing a heating or cooling of a bed, the warmer including at least one mattress pad coupled to a heating and cooling device through a flexible and extendible hose, the heating and cooling device providing a source of temperature controlled pumped air which may be introduced into the mattress pad, the heating and cooling device including an outer casing having:

an air inlet for drawing air in from the atmosphere; and an air outlet for expelling atmospheric air;

a mattress outlet which may be coupled to the flexible and extendible hose and through which air is pumped, the air having been temperature conditioned by the heating and cooling device either by heating the air, maintaining the air at its ambient temperature, or cooling the air; and wherein the air inlet and air outlet are on a first face of the casing, the mattress outlet being provided on a side of the casing substantially perpendicular to the first face, the casing being locatable relative to the bed in one of two orientations, a first orientation providing for the mattress outlet to be substantially perpendicular to the mattress pad and a second orientation providing for the mattress outlet to be substantially parallel to the mattress pad in use, an extension of the hose allowing the casing to be moved from the first to the second orientations.

Other aspects of the invention are as described in the claims herein.

BRIEF DESCRIPTION OF THE DRAWINGS

For a better understanding of the invention and to show how the same may be carried into effect, there will now be described by way of example only, specific embodiments, methods and processes according with reference to the accompanying drawings in which.

DETAILED DESCRIPTION

There will now be described by way of example a specific mode contemplated by the inventors. In the following description numerous specific details are set forth in order to provide a thorough understanding. It will be apparent however, to one skilled in the art, that the present invention may be practiced without limitation to these specific details. In other instances, well known methods and structures have not been described in detail so as not to unnecessarily obscure the description.

Figure 1:
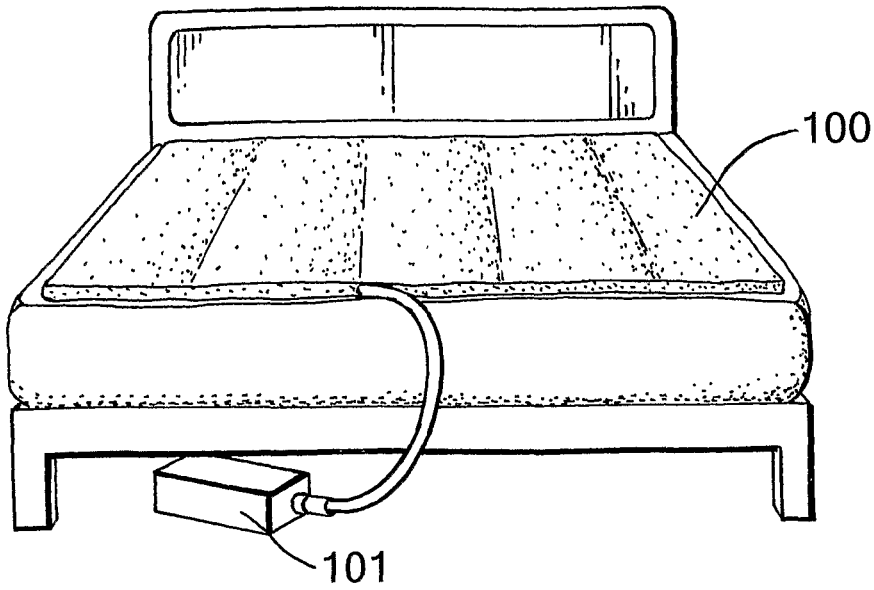
FIG. 1 illustrates schematically a temperature controllable mattress cover placed on top of a mattress, and supplied by temperature conditioned air via a heating and cooling device according to a first specific embodiment.

Referring to FIG. 1 herein, there is illustrated schematically a mattress cover 100 for fitting onto a bed, the mattress cover formed from a hollow resilient material having a plurality of air channels passing there through; and an air heating and cooling device 101 for supplying heated or cooled air to the mattress cover 100, such that when heated air is supplied by the heating and cooling device, the mattress cover becomes warm relative to an ambient air temperature, and when cooled air is supplied by the cooling device 101, the mattress cover 100 becomes cooled relative to the ambient air temperature. The heating and cooling device 101 supplies air to the mattress cover 100 via a supply tube 102.

Air flow through the heating and cooling device and mattress cover is in a single direction. External ambient air enters the heating and cooling device 101, is either heated or cooled, and is pumped through the delivery tube 102 to the mattress cover 100. Alternatively, heating or cooling may not be applied, and the air may be kept at the same ambient temperature and pumped through the supply tube 102 into the mattress cover 100. Air exits the mattress cover 100 either at a fixed exit point, after passing along the mattress cover, or in another embodiment, where the mattress cover has a large number of small air holes along its upper and/or lower and/or side surfaces, air may leak out of the fabric of the mattress cover, giving warmed or cooled air over the upper and/or lower and/or side surfaces of the mattress cover, as well as reducing or raising the temperature of the upper and lower surfaces of the mattress cover, depending upon whether the heating and cooling device is operating in a heating mode, or in a cooling mode.

Figure 2:
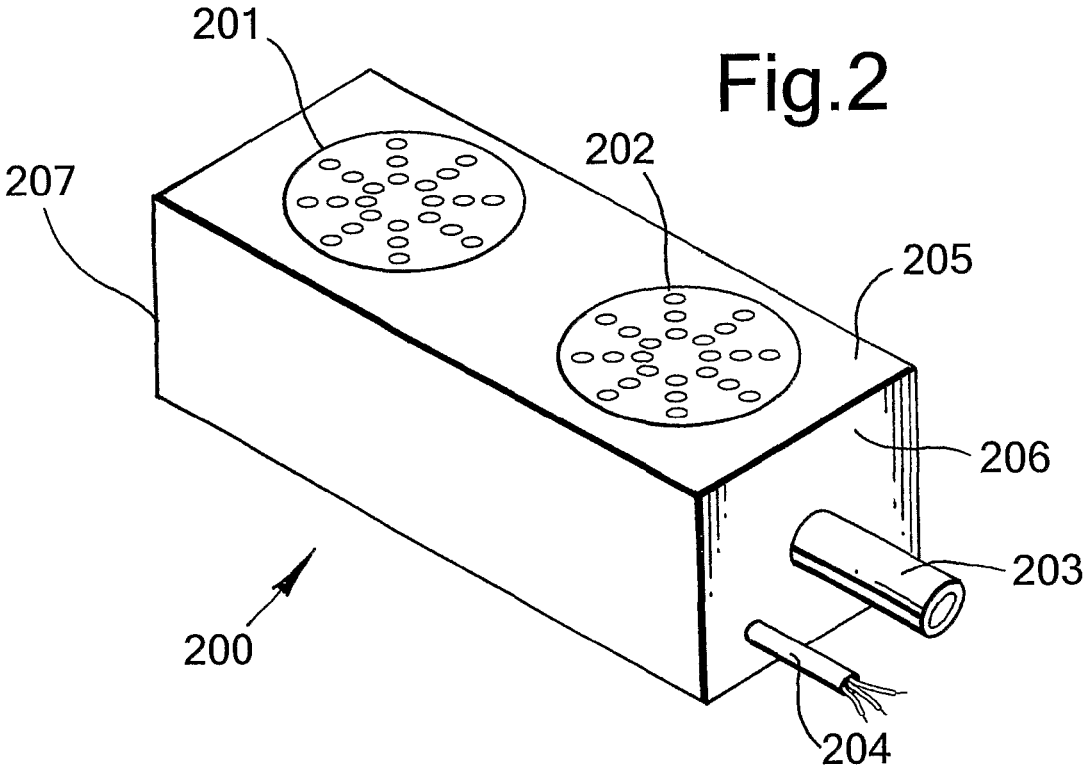
FIG. 2 illustrates schematically in external schematic view a first specific embodiment of an air heating and cooling device.

Referring to FIG. 2 herein, there is illustrated schematically in perspective view the heating and cooling device 101 shown externally. The heating and cooling device comprises an outer casing 200, which can be a variety of different shapes but in a best mode is in a rectangular "brick" shape, the outer casing having an air inlet 201 for drawing air in from the atmosphere, and an air outlet 202 for expelling atmospheric air; an outlet pipe 203, through which air is pumped, the air having been temperature conditioned by the heating and cooling device either by heating the air, maintaining the air at its ambient temperature, or cooling the air; and a power supply cable 204.

In the embodiments shown, air inlet 201 and air outlet 202 are on a same face of the casing. This enables the heating and cooling device to be placed in a maximum number of orientations on a floor surface, up or against a wall or other item of furniture. In the embodiments shown in FIG. 2, there are two surfaces on which the heating and cooling device cannot be rested, this being an upper surface 205 on which the air inlet and air outlet are present, and an end surface 206 out of which the supply tube 203 and electrical connector cable 204 are positioned on. However, the heating and cooling device can be placed to rest on any of the remaining force on obstructed surfaces. Further, the heating and cooling device can be placed on its base surface, and a first or second side surface or a second end surface 207 may abut an adjoining wall or item of furniture.

Figure 3:
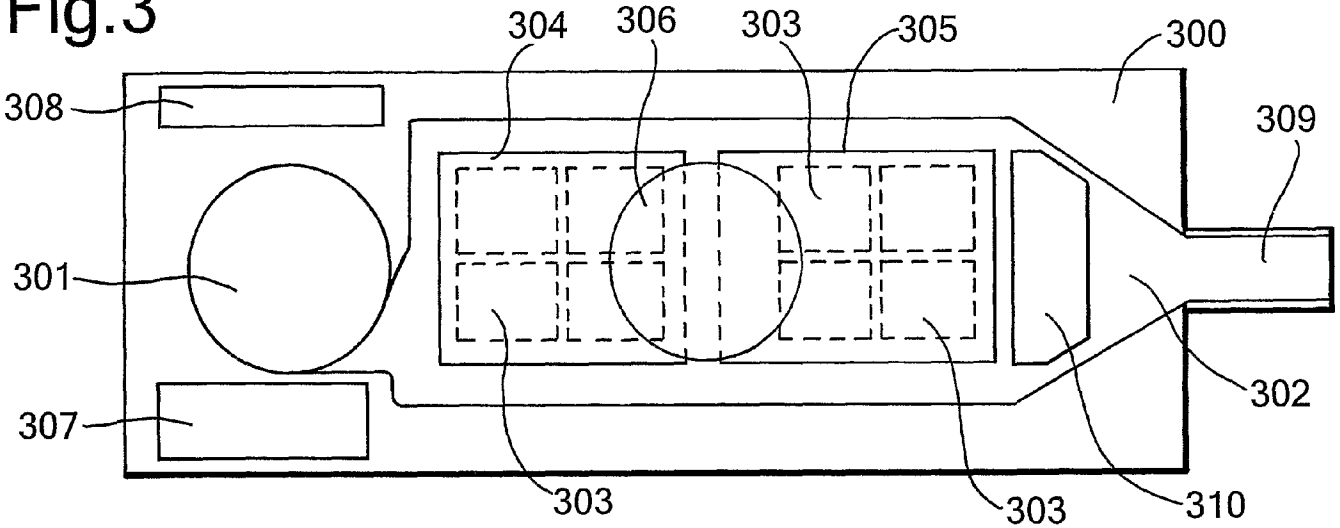
FIG. 3 illustrates schematically in plan view, components of the first heating and cooling device of FIG. 2.

Referring to FIG. 3 herein there is illustrated schematically in plan view from above, components of the heating and cooling device.

The heating device comprises a base plate 300 onto which other components are mounted; an inlet fan 301 for drawing atmospheric air into the device; a plurality of air channels 302 for passage of air through the device; an array of Peltier heating and cooling devices 303 arranged in series and parallel; a plurality of heat sinks 304, 305 situated in the air passages, and arranged such that air flows through the heat sinks, the heat sinks arranged for sinking heating to and from the Peltier heating devices; an outlet extractor fan 306 for drawing waste air out of the device; a power supply unit 307 for powering the Peltier devices, inlet and outlet fans, and a control circuit; and a control circuit 308 for controlling the heating and cooling device; and an outlet 309 for passage of conditioned air from the heating and cooling device.

Figure 4:
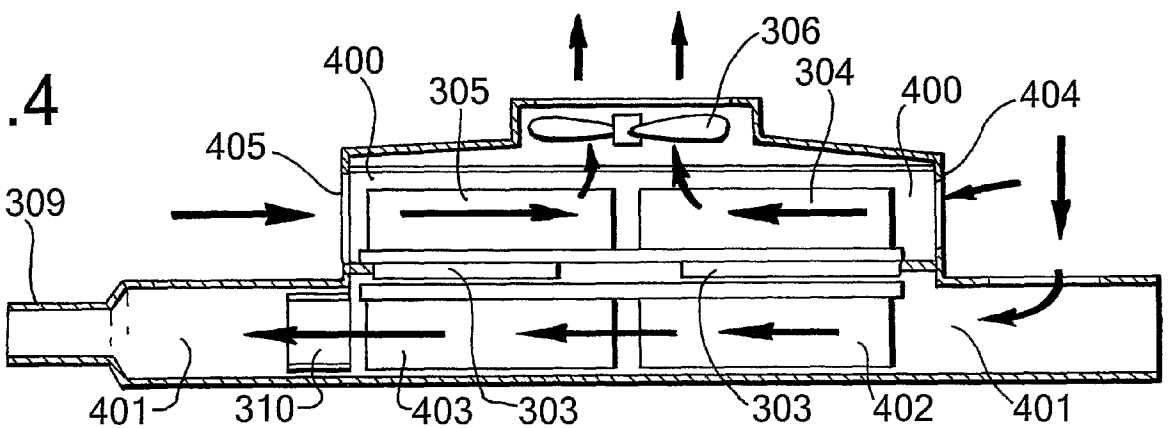
FIG. 4 illustrates schematically in side view, flows of air through the first heating and cooling device of FIGS. 2 and 3.

Referring to FIG. 4 herein, there is illustrated schematically in view from an opposite side, the heating and cooling device of FIG. 3 showing passage of air through the device. The heating and cooling device comprises an upper air channel 400 and a lower air channel 401. The upper and lower air channels being separated from each other by the array of Peltier effect devices 303. Arrows indicate the direction of air flow in each of the upper and lower air channels.

Examining first the lower air channel 401, air enters the device via the inlet apertures 201, drawn in by the electrically operated inlet fan 301. Air is forced through the lower channel 401 through a first lower heat sink 402 and through a second lower heat sink 403, the first and second lower heat sinks being arranged in series of each other. Each heat sink comprises a metal body formed into a shape of fins in order to maximise heat exchange between the heat sink and the air passing through the heat sink, whilst providing minimised disruption to the air flow through the lower heating/cooling passage. Serially after the first and second heat sinks, the air passes through the ceramic heater device 310, and through to the outlet pipe 309.

Examining the upper air channel 400, the upper air channel has a plurality of inlet apertures 402, 403 oppositely facing each other, from which air may be drawn in from inside the casing, the air having entered the casing via inlet apertures 201 in the casing. Air entering via rear aperture 402 passes through a first upper heat sink 304 and is drawn out of the upper air channel by extractor fan 306 and out of the casing via outlet apertures 202 as herein before described. In an opposite direction, air entering from the casing into the front inlet 403 of the upper air channel passes through second heat sink 305, drawn through the heat sink by the electric extractor fan 306 and out of the casing via outlet apertures 202.

The heating and cooling device is capable of three modes of operation being heating the ambient air, cooling the ambient air, or maintaining the air at its existing ambient temperature.

Peltier devices 303 are positioned between the first set of heat sinks in the heating/cooling channel 401, and the second set of heat sinks 304, 305 in the exhaust air channel 400.

In a heating mode, operation of the heating and cooling device is as follows. The plurality of Peltier devices 303 are controlled so as to pump heat from the exhaust heat sinks 304, 305 to the heating/cooling channel heat sinks 402, 403 so that the heat sinks in the lower heating/cooling air channel become relatively warmer compared to the heat sinks in the exhaust air channel, and the heat sinks in the air heating/cooling channel become hot enough to heat the air passing through the channel. Air is drawn into the heating/cooling channel via the inlet fan 301, passes through the first and second heat sinks of the air heating/cooling channel and then through the ceramic heater 310 in order to obtain an extra boost of heating, before being expelled through the air outlet 309. The exhaust air channel 400 draws in air through its first and second inlets 404, 405 respectively, and over the first and second exhaust heat sinks 304, 305. The air flow over the exhaust heat sinks prevents the Peltier devices over heating, and enables a temperature differential between the exhaust air, and the air supply to the mattress. Heat is extracted from the exhaust air passing through the exhaust channel and transferred to the air supply outlet 309, the heat being pumped between the two air flows by the array of Peltier heat pump devices 303.

In a cooling mode, operation of the device is as follows. In the air conditioning channel 401, air is drawn in through the inlet fan 301 and passes through the first and second heat sink 402, 403 respectively in the air conditioning channel, and then through the ceramic heater 310 and out through the air supply outlet 309. The ceramic heater 310 is turned off so as not to heat the air. The Peltier devices operate to cool the first and second lower heat sinks in the air conditioning channel, relative to ambient atmospheric air temperature so that air passing through the air conditioning channel experiences a reduction in temperature. The Peltier devices 303 pump heat from the heat sinks in the air conditioning channel to the heat sink 304, 305 in the exhaust channel.

In the exhaust channel, in the cooling mode, outlet fan 306 draws air through the first and second inlets 404, 405 respectively of the exhaust channel and through the exhaust heat sinks 305, 306. Since the exhaust heat sinks 304, 305 are at a relatively higher temperature than the air conditioning heat sinks 402, 403 heat is transferred to the exhaust air flow and is expelled through the exhaust outlet apertures 202 of the device.

In a third mode of operation, where the heating and cooling device operates simply as an air pump, the Peltier devices are turned off and the ceramic heater is also turned off so that no active heating or cooling of the air in the air conditioning channel occurs.

Air is drawn into the inlet of the air conditioning channel by the inlet fan 306, is forced through the air conditioning channel heat sinks and through the ceramic heater, each of which are in an "off" condition supplying no heat and extracting no heat, and out of the outlet 309. In this mode of operation, the exhaust channel 400 may be inactive, with the exhaust fan 306 being turned off in order to save power.

As mentioned herein above, problems with prior art cooling devices revolve around the practicalities of reducing the size of casing and increasing the efficiency of cooling to make a commercially practical sized device, which so far in the prior art has failed to be achieved.

In the present embodiments, the lay out, design of the air channels and component selection needs to be optimised in order to achieve a practically workable heating and cooling device which is of an acceptable size and weight for domestic use.

Figure 5:
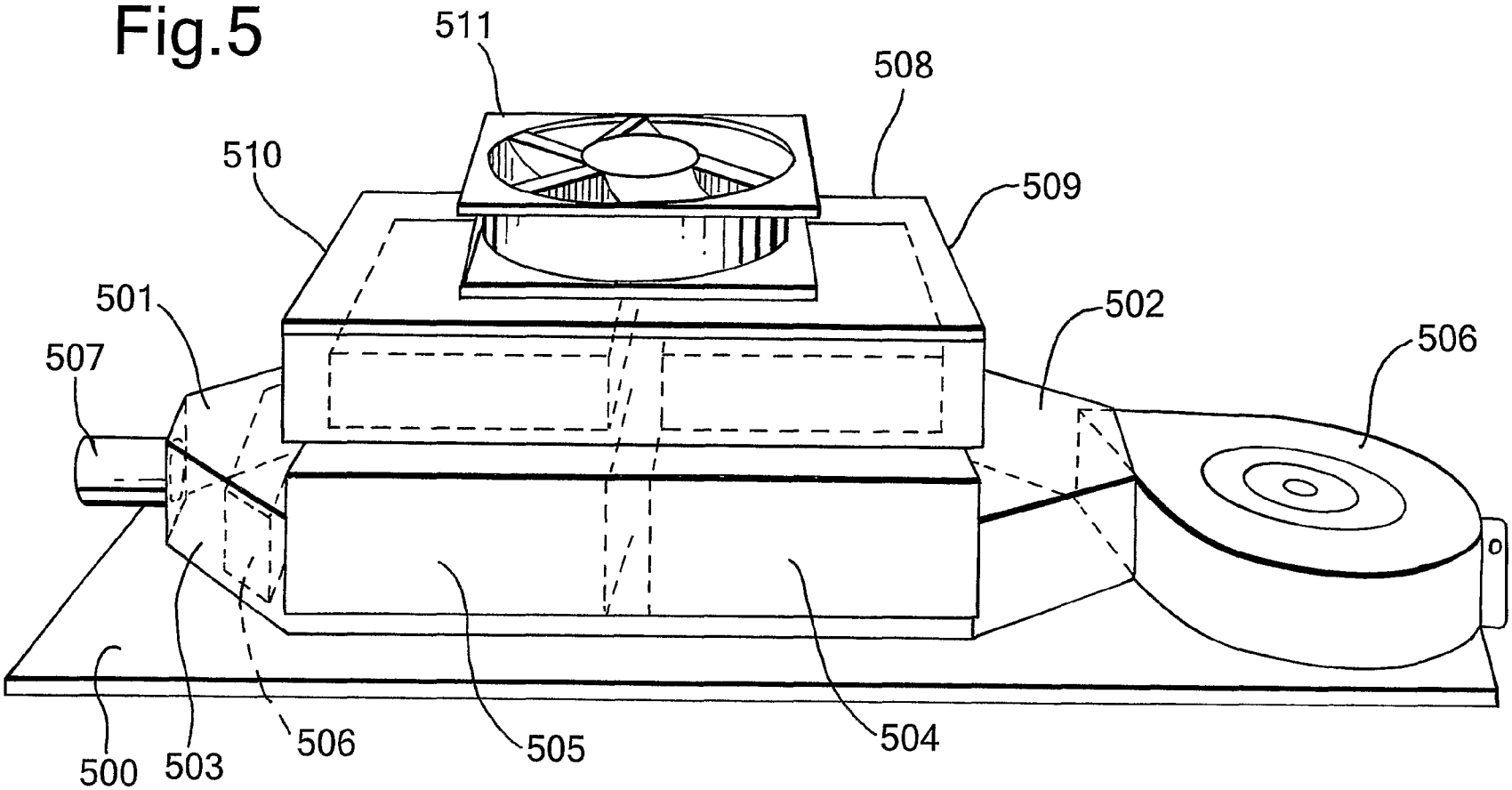
FIG. 5 illustrates schematically in perspective view from the side, a layout of a second air heating and cooling device according to a second specific embodiment.

Referring to FIG. 5 herein, there is illustrated schematically a first prototype heating and cooling device according to a second specific embodiment, showing a practical air passageway, shape and layout and positioning of components within a casing.

A second embodiment heating and cooling device comprises a base plate 500 onto which is mounted a tubular structure 501 forming an air conditioning air channel, and an upper tubular structure 502 forming an exhaust channel. The air conditioning channel 501 comprises a substantially rectangular cross sectional tubular passage having at an inlet end a tapered inlet 503 and an outlet end, a tapered outlet portion 504. Within the air conditioning channel are positioned one or a plurality of cast aluminum heat sink devices 504, 505, through which the air is forced by inlet fan 506. Inlet fan 506 is placed with its main axis of rotation substantially perpendicular to a main plane of the base plate 500, so as to draw air in from a direction transverse to the main plane of the base plate. Air therefore passes through 90 degrees through the fan to be expelled in a transverse direction along a main length of the air conditioning passageway 501. The ceramic heating device 506 is positioned in the air conditioning channel in the air flow, after the heat sinks and Peltier heat pump devices, and before the outlet 507.

The exhaust air channel 508 comprises a substantially tubular structure, substantially rectangular in cross section, having first and second apertures at opposite ends of the tubular structure, the tubular structure having a central aperture over which an exhaust fan 511 is fitted such that the exhaust fan draws air through the outlet aperture in the upper face of the exhaust passage, whilst the air is drawn in through the first and second opposite air inlets. Air is drawn from the inlets, over a plurality of heat sink devices and out of the outlet of the exhaust passage, under the force of the electric extractor fan 511.

The Peltier devices are positioned between the exhaust heat sinks and the air conditioning heat sinks to pump heat between the exhaust heat sinks and the air conditioning heat sinks. Depending upon how the Peltier devices are driven, the flow of heat between the exhaust heat sinks and the air conditioning heat sinks can be reversed, and increased or decreased as desired.

In the best mode, approximate dimensions for the exhaust air passage, air conditioning air passage, and overall size of the heating and cooling device are as follows.

The overall dimensions of the heating and cooling device are in the range width 15 to 36 cm; height 7 to 15 cm, and length 20 to 40 cm.

The exhaust air passage may have an internal cross sectional area through which air flows, of dimensions in the range 30 $cm^2$ to 108 $cm^2$. The air conditioning air channel may have an internal cross sectional area in a direction perpendicular to a main airflow direction in the range 30 $cm^2$ to 120 $cm^2$.

Typically, each Peltier effect device may have dimensions in the range 40 mm×40 mm, and an array of Peltier effect devices may comprise eight individual devices arranged in two sets of four devices, the two sets being positioned serially within the device.

Figure 6:
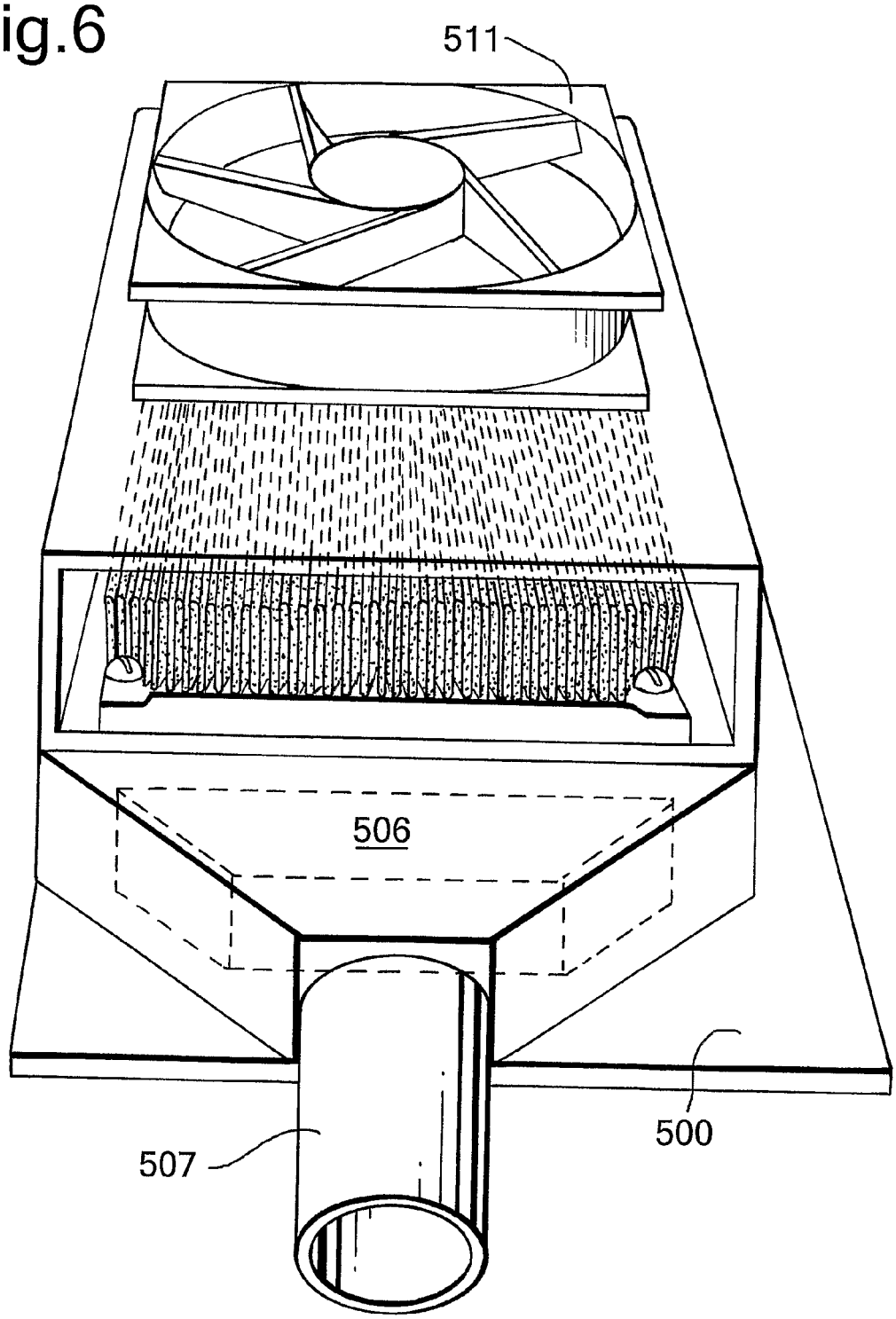
FIG. 6 illustrates schematically in view from one end components of the second air heating and cooling device.

Referring to FIG. 6 herein, there is illustrated schematically the second embodiment heating and cooling device of FIG. 5 shown in disassembled end view. For ease of explanation, the moldings surrounding the exhaust air channel and the air conditioning air channel are formed of transparent plastics material, so that the internal heat sink components and ceramic heater components are visible.

Clearly viewable are the forward heat sink of the exhaust channel, which is formed as an aluminum casting, having a plurality of parallel extending fins which are positioned in a direction along the exhaust air channel, so that air flows between the fins. In this arrangement, the air passing through the exhaust channel is exposed to a maximum fin area, over a maximum distance between the inlet and outlet of the exhaust channel, whilst at the same time impeding to a minimum extent, the passage of air.

Figure 7:
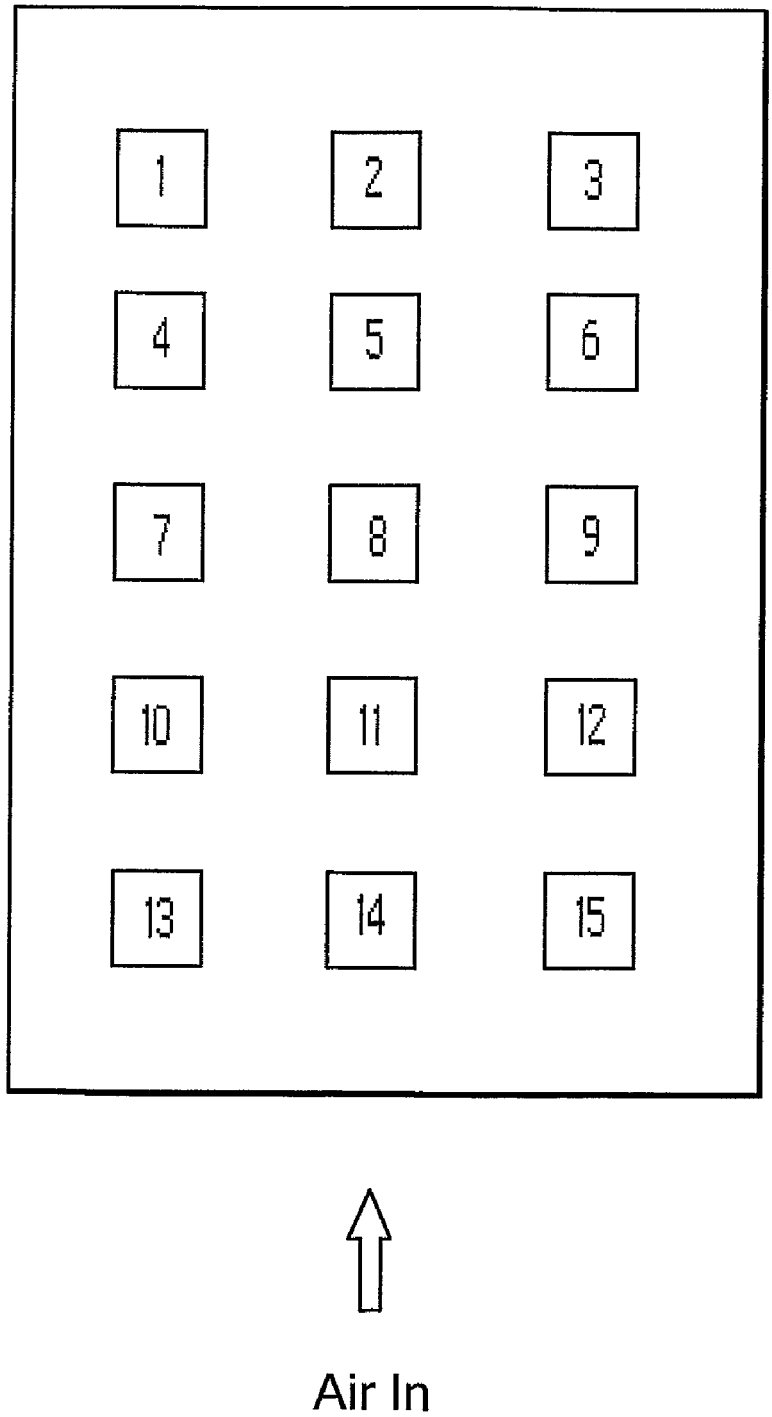
FIG. 7 illustrates schematically a probe layout on top of an air mattress, of the type having a plurality of air channels within the mattress.

FIG. 7 illustrates schematically a probe layout on top of an air mattress, of the type having a plurality of air channels within the mattress;

In a test situation, 15 probes are arranged in an array of five rows and three columns, spaced approximately equidistantly from each other and covering the whole of an area of an air mattress suitable for covering a double divan sized bed.

Figure 8:
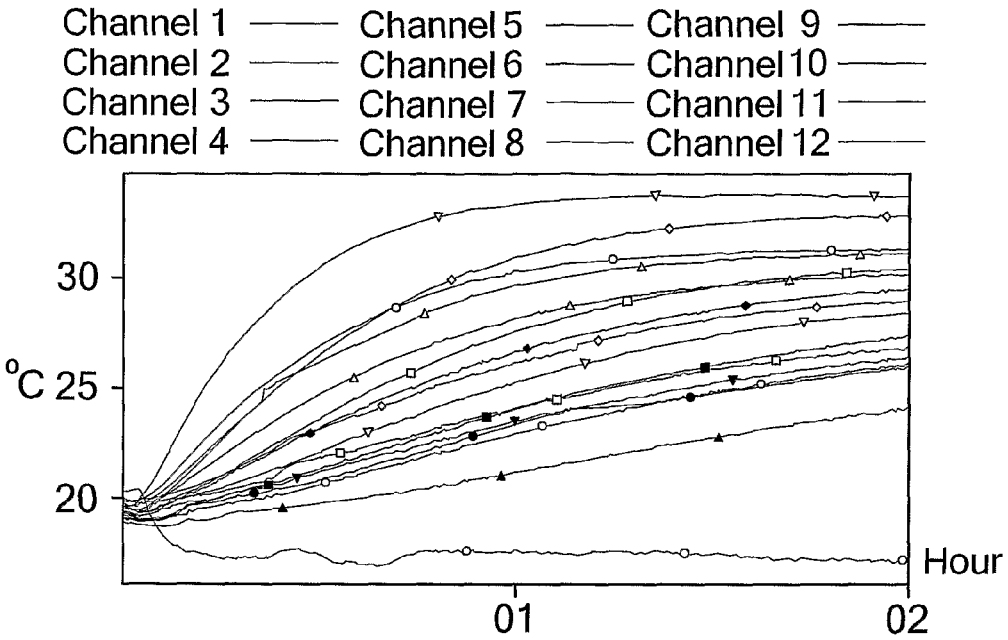
FIG. 8 illustrates schematically a plot of temperature against time for temperature probes placed at a plurality of positions on the air mattress of FIG. 7, when supplied with temperature conditioned air by a heating and cooling device according to a specific embodiment herein.

FIG. 8 illustrates schematically a plot of temperature against time for temperature probes placed at a plurality of positions on the air mattress of FIG. 7, when supplied with temperature conditioned air by a heating and cooling device according to a specific embodiment herein;

In a heating mode, an upper surface of the air mattress was tested to rise within 6 minutes, to a temperature of between one and fourteen degrees above ambient temperature at the start of the test, and after twelve minutes, tended towards a range of between four and fourteen degrees above initial ambient temperature.

Figure 9:
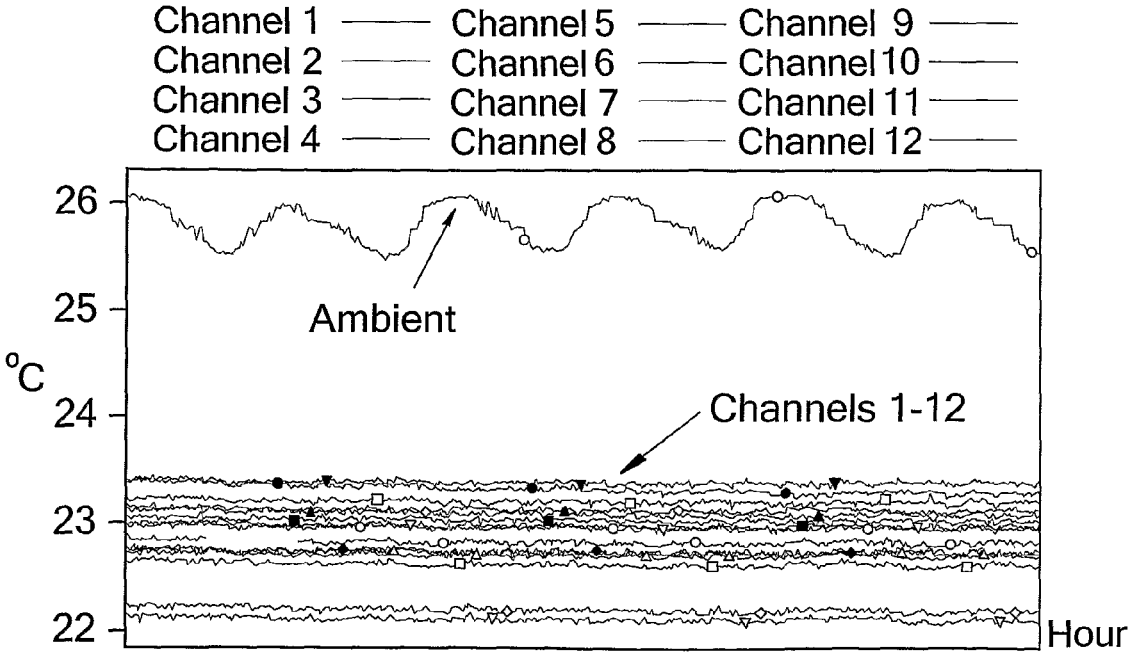
FIG. 9 illustrates schematically a plot of temperature against time for an air mattress supplied with cooled air from a heating and cooling device according to a specific embodiment herein.

FIG. 9 illustrates schematically a plot of temperature against time for an air mattress supplied with cooled air from a heating and cooling device according to a specific embodiment herein.

In a cooling mode test, where the ambient atmospheric temperature around an air mattress varied in the range 25.5 to 26.3° C., the heating and cooling device was tested as being capable of driving a double divan sized air mattress in steady state operation, with a temperature variation of around 1.5° C. across the mattress surface, with the overall temperature being in the range of between 2 and 3.2° C. below ambient temperature.

Figure 10:
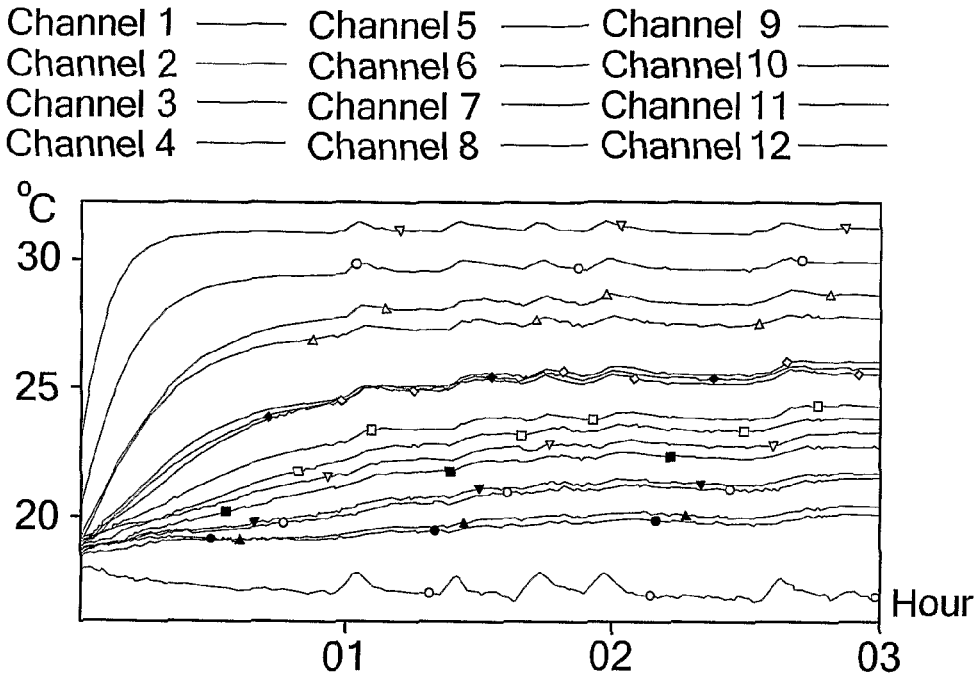
FIG. 10 illustrates schematically a plot of temperature against time measured by a series of probes placed on an air mattress supplied with temperature controlled air from a heating and cooling device as described herein wherein a 10 tog quilt covers the air mattress, with the quilt facing down.

FIG. 10 illustrates schematically a plot of temperature against time measured by a series of probes placed on an air mattress supplied with temperature controlled air from a heating and cooling device as described herein wherein a 10 tog quilt covers the air mattress, with the quilt facing down.

In a heating mode test, with a 10 tog quilt covering a double divan sized air mattress, the heating and cooling device was tested as being capable of producing an increase of temperature of up to 11° C. within 2 minutes of commencing the heating mode, and maintaining a surface temperature of the air mattress in the range up to 17° C. above ambient temperature as measured at the beginning of the test.

Figure 11:
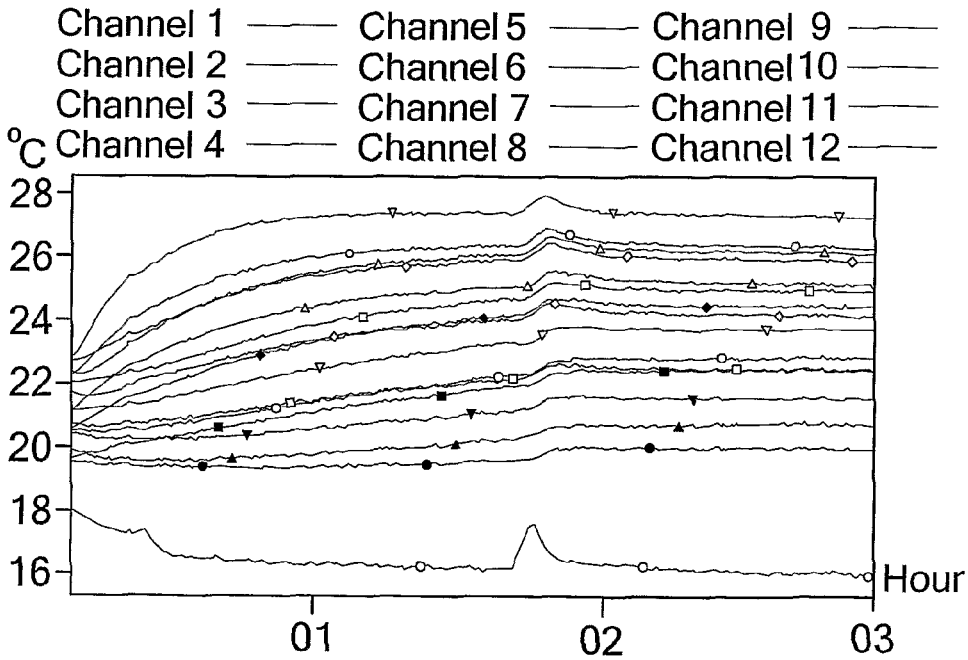
FIG. 11 illustrates an equivalent plot to FIG. 10, with a 10 tog quilt covering an air mattress, but with the quilt facing the other way up.

FIG. 11 illustrates an equivalent plot to FIG. 10, with a 10 tog quilt covering an air mattress, but with the quilt facing the other way up.

In a heating mode, with an impervious material below the air mattress, the heating and cooling device was shown to be capable of driving the air mattress so as to produce a surface temperature on the air mattress surface of between 3 and 14° C. above ambient temperature at the start of the test, within a 6 minute period from the start of the heating mode, and of achieving a temperature in the range 6 to 15° C. above ambient temperature at the start of the test within a period of 12 minutes from the start of the test.

Figure 12:
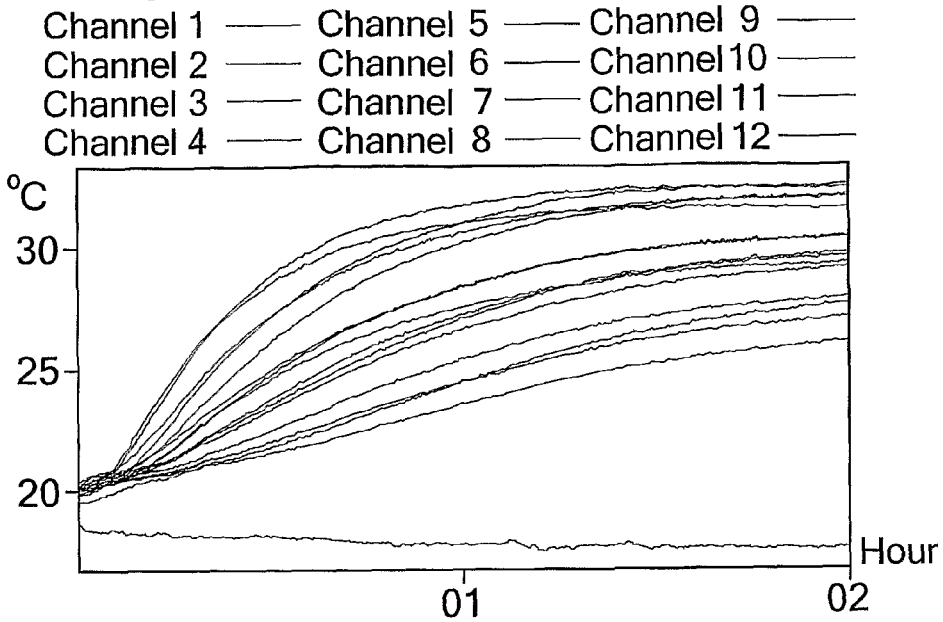
FIG. 12 illustrates schematically a plot of temperature against time for an air mattress supplied with temperature conditioned air by a heating and cooling device according to an embodiment described herein, where an impervious material is placed underneath the air mattress.

FIG. 12 illustrates schematically a plot of temperature against time for an air mattress supplied with temperature conditioned air by a heating and cooling device according to an embodiment described herein, where an impervious material is placed underneath the air mattress.

In a heating mode test with an impervious material placed below an air mattress and a lower ¾ of the air mattress being covered by a blanket, the heating and cooling device was capable of driving the air mattress to give temperatures in the range 5 to 17° C. above ambient temperature at the start of the test, within 6 minutes of commencement of the heating mode test.

Figure 13:
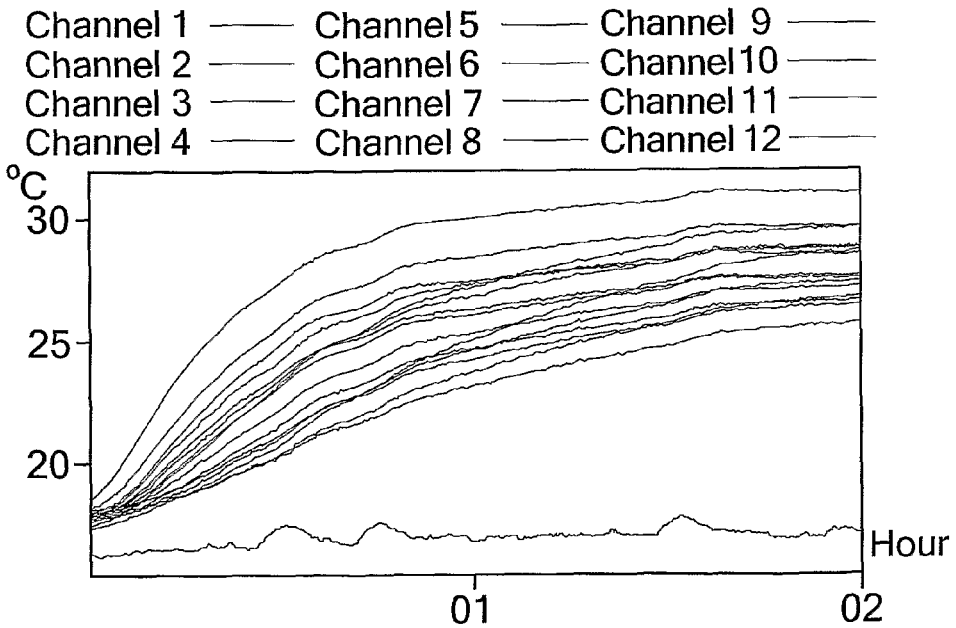
FIG. 13 illustrates schematically a plot of temperature against time for a plurality of positions on an air mattress supplied with temperature conditioned air wherein an impervious material is placed underneath the air mattress, and a ¾ portion of the air mattress is covered by a blanket.

FIG. 13 illustrates schematically a plot of temperature against time for a plurality of positions on an air mattress supplied with temperature conditioned air wherein an impervious material is placed underneath the air mattress, and a % portion of the air mattress is covered by a blanket.

Figure 14:
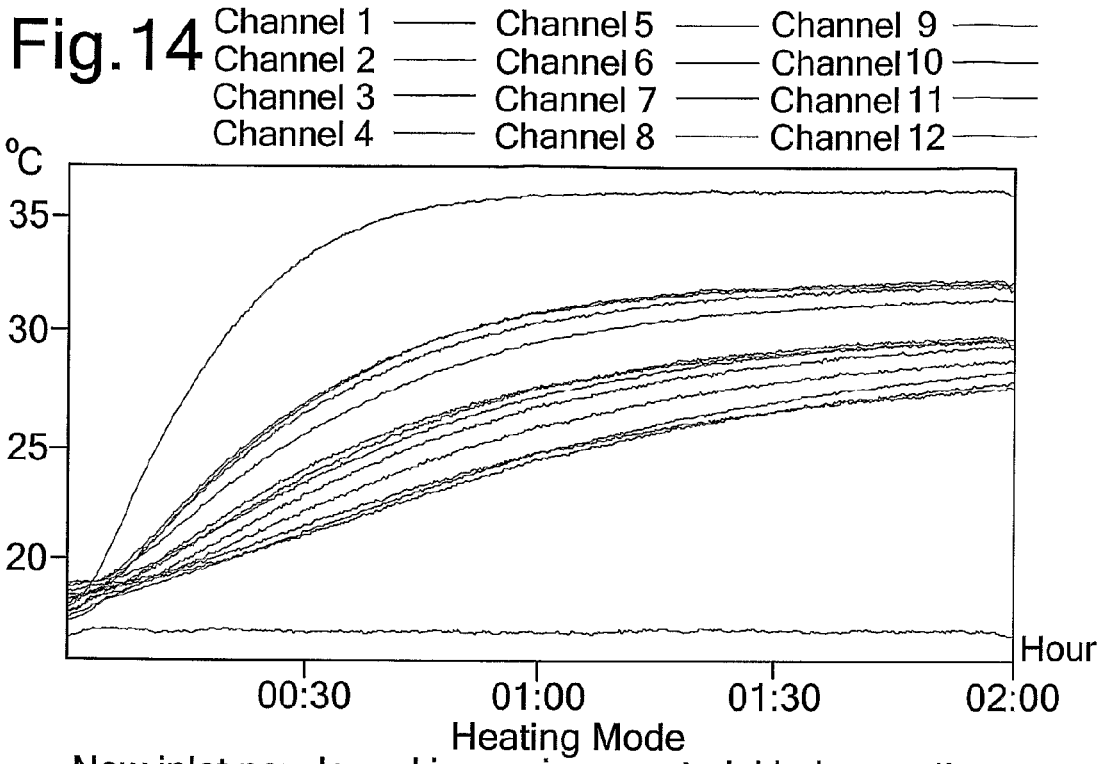
FIG. 14 illustrates schematically a plot of temperature against time for an air mattress supplied with temperature conditioned air by a specific embodiment heating and cooling device herein, wherein an impervious material is placed underneath the air mattress and the air mattress has a different inlet nozzle, where the heating and cooling device is operated in a heating mode.

FIG. 14 illustrates schematically a plot of temperature against time for an air mattress supplied with temperature conditioned air by a specific embodiment heating and cooling device herein, wherein an impervious material is placed underneath the air mattress and the air mattress has a different inlet nozzle, where the heating and cooling device is operated in a heating mode.

In a heating mode test with an impervious material below the mattress, the heating and cooling device was capable of driving the air mattress to achieve a mattress surface temperature in the range 6 to 19° C. above ambient temperature at the start of the test, after a one hour period.

Figure 15:
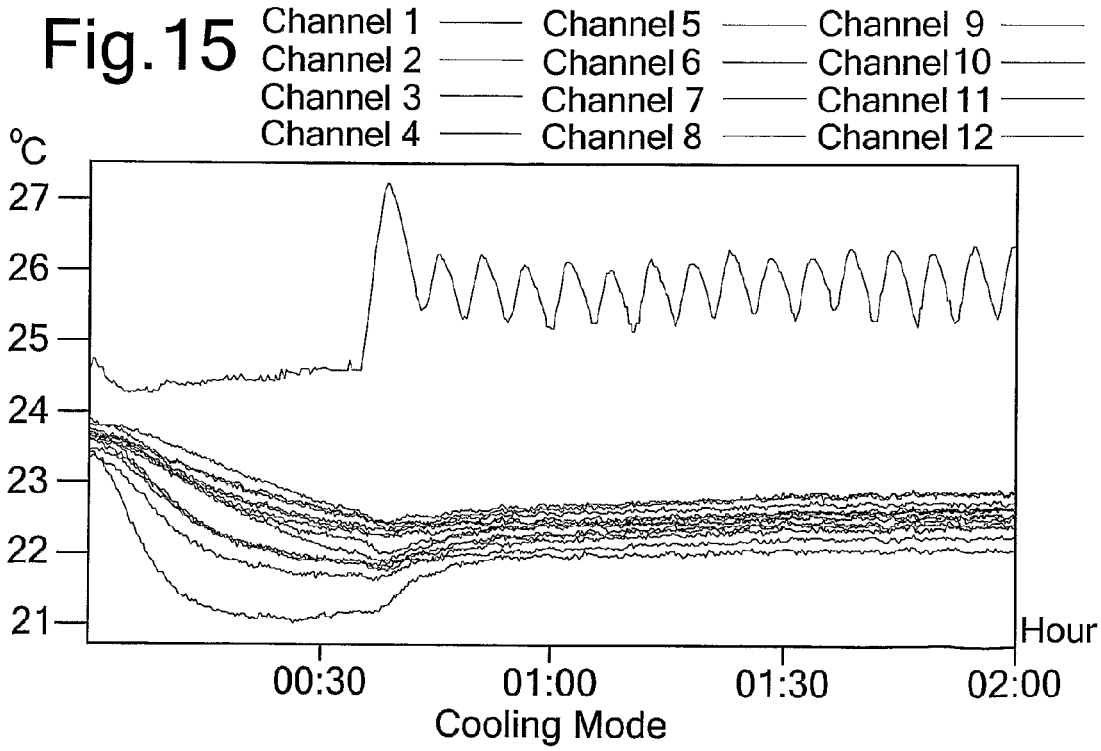
FIG. 15 illustrates schematically an equivalent plot to FIG. 14, but with the heating and cooling device driven in a cooling mode.

FIG. 15 illustrates schematically an equivalent plot to FIG. 14, but with the heating and cooling device driven in a cooling mode.

With the heating and cooling device in a cooling mode, the device was capable of driving an air mattress having an impervious material below the mattress to a temperature in the range 2 to 4° C. below ambient temperature after a one hour period, and to maintain that temperature range indefinitely thereafter.

Figure 16:
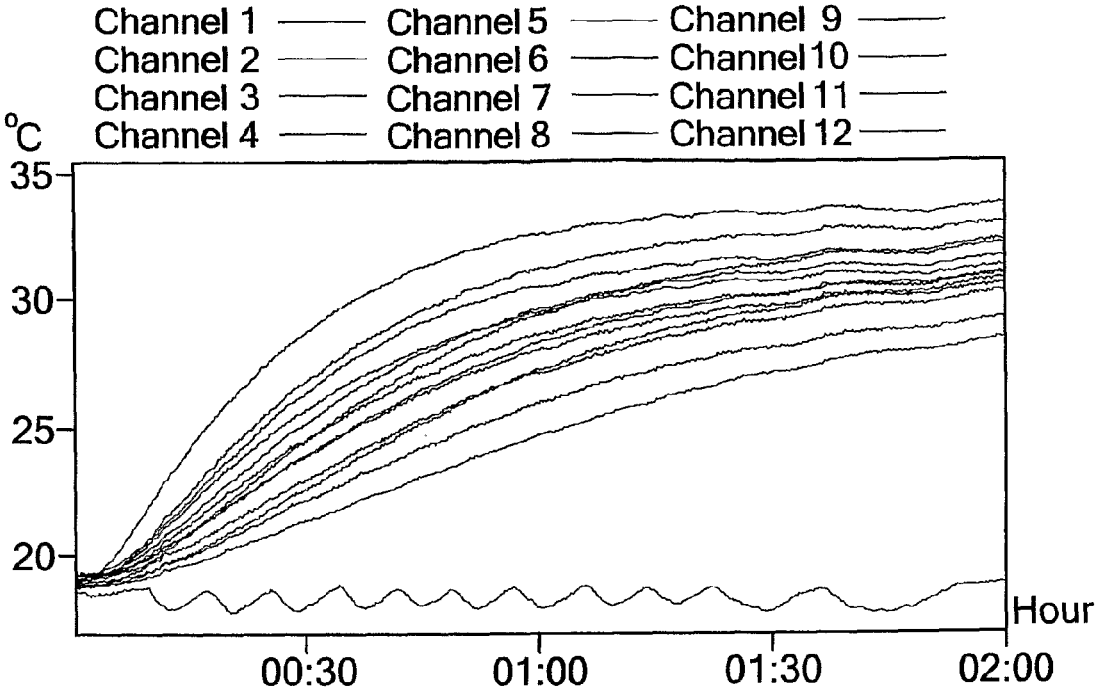
FIG. 16 illustrates schematically a plot of temperature against time for the air mattress driven as in FIG. 14, but with a 400 mm length of the upper surface of the air mattress covered by an impervious material.

FIG. 16 illustrates schematically a plot of temperature against time for the air mattress driven as in FIG. 14, but with a 400 mm length of the upper surface of the air mattress covered by an impervious material.

In a heating mode, with impervious material placed below an air mattress and a lower 400 mm of the mattress upper surface covered by a blanket, after 2 hours from start of the test, the heating and cooling device was found capable of driving the surface temperature of the air mattress to a temperature of between 10 and 17° C. above ambient, and of maintaining that temperature range indefinitely thereafter.

Figure 17:
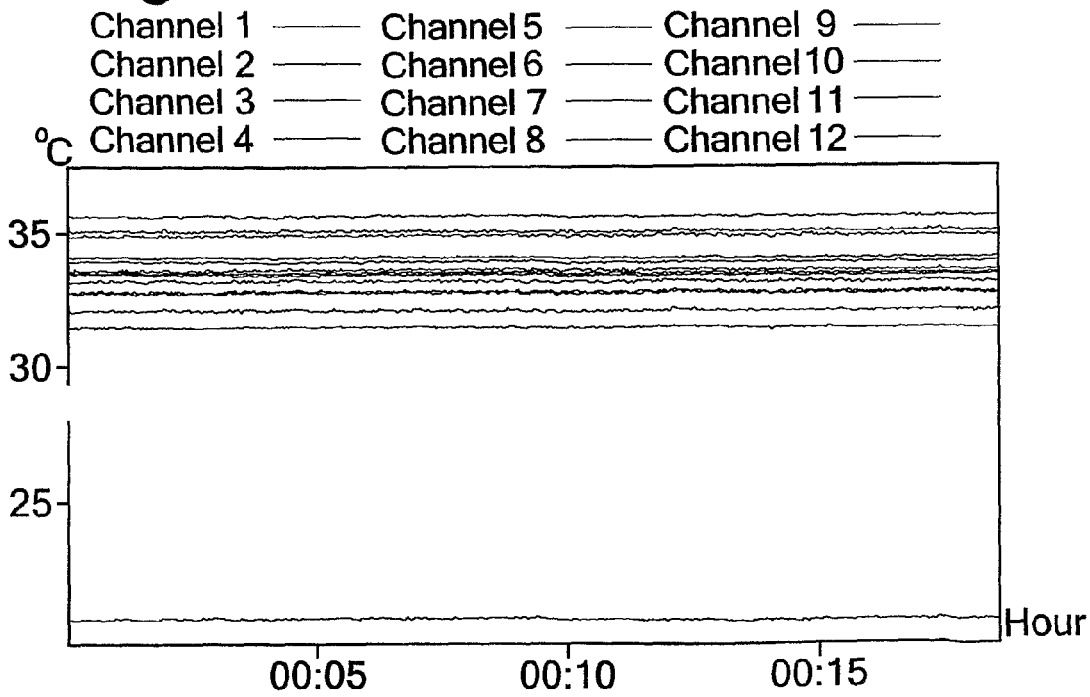
FIG. 17 illustrates schematically a plot equivalent to that of FIG. 16, but wherein the heating and cooling device has been left on for a long period, for example all night.

FIG. 17 illustrates schematically a plot equivalent to that of FIG. 16, but wherein the heating and cooling device has been left on for a long period, for example all night.

Figure 18:
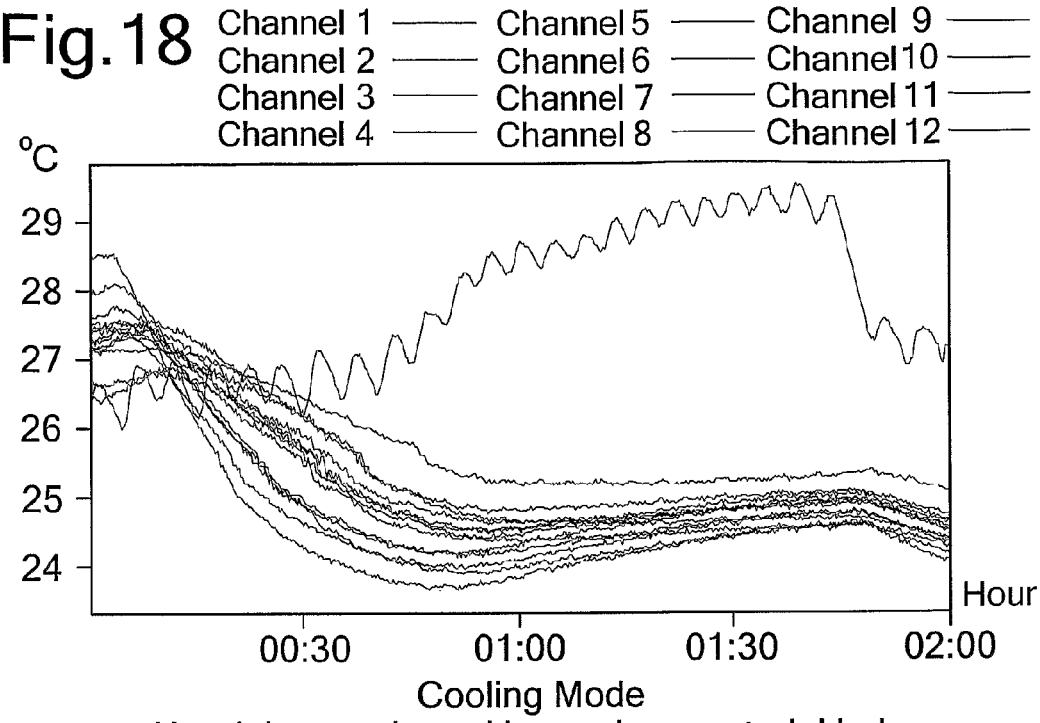
FIG. 18 illustrates schematically a plot of temperature against time for an air mattress driven by a heating and cooling device as described herein in a cooling mode, with a replacement inlet nozzle and an impervious material below the mattress and covering a 400 mm length of upper surface of the air mattress.

FIG. 18 illustrates schematically a plot of temperature against time for an air mattress driven by a heating and cooling device as described herein in a cooling mode, with a replacement inlet nozzle and an impervious material below the mattress and covering a 400 mm length of upper surface of the air mattress.

In a cooling mode, the heating and cooling device was tested to be capable of driving an air mattress having an impervious material below the mattress and a bottom 400 mm of the surface covered by a blanket, to a cooled temperature, in the range 1.5 to 6° C. below the corresponding ambient temperature at the start of the test, after a period of one hour from test commencement.

Figure 19:
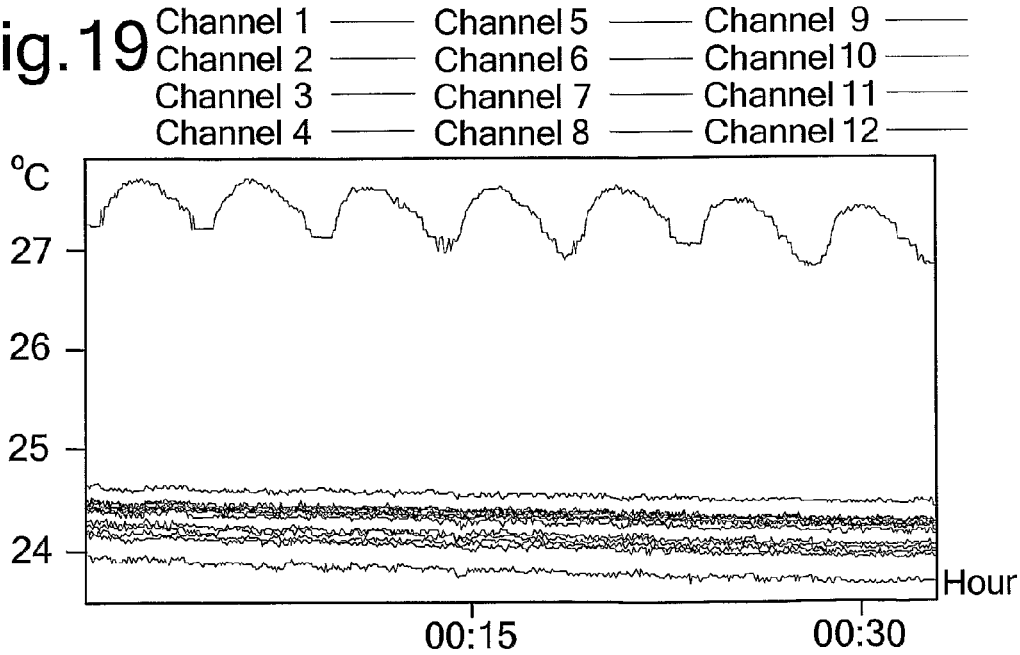
FIG. 19 illustrates schematically a plot equivalent to that of FIG. 19, but wherein the air mattress has been left for an extended period, for example overnight and has reached a steady state temperature condition.

FIG. 19 illustrates schematically a plot equivalent to that of FIG. 19, but wherein the air mattress has been left for an extended period, for example overnight and has reached a steady state temperature condition.

In steady state, after an all night test, the heating and cooling device in a cooling mode was tested as driving a mattress at a temperature range of between 2 and 4° C. below ambient external atmospheric temperature.

Figure 20:
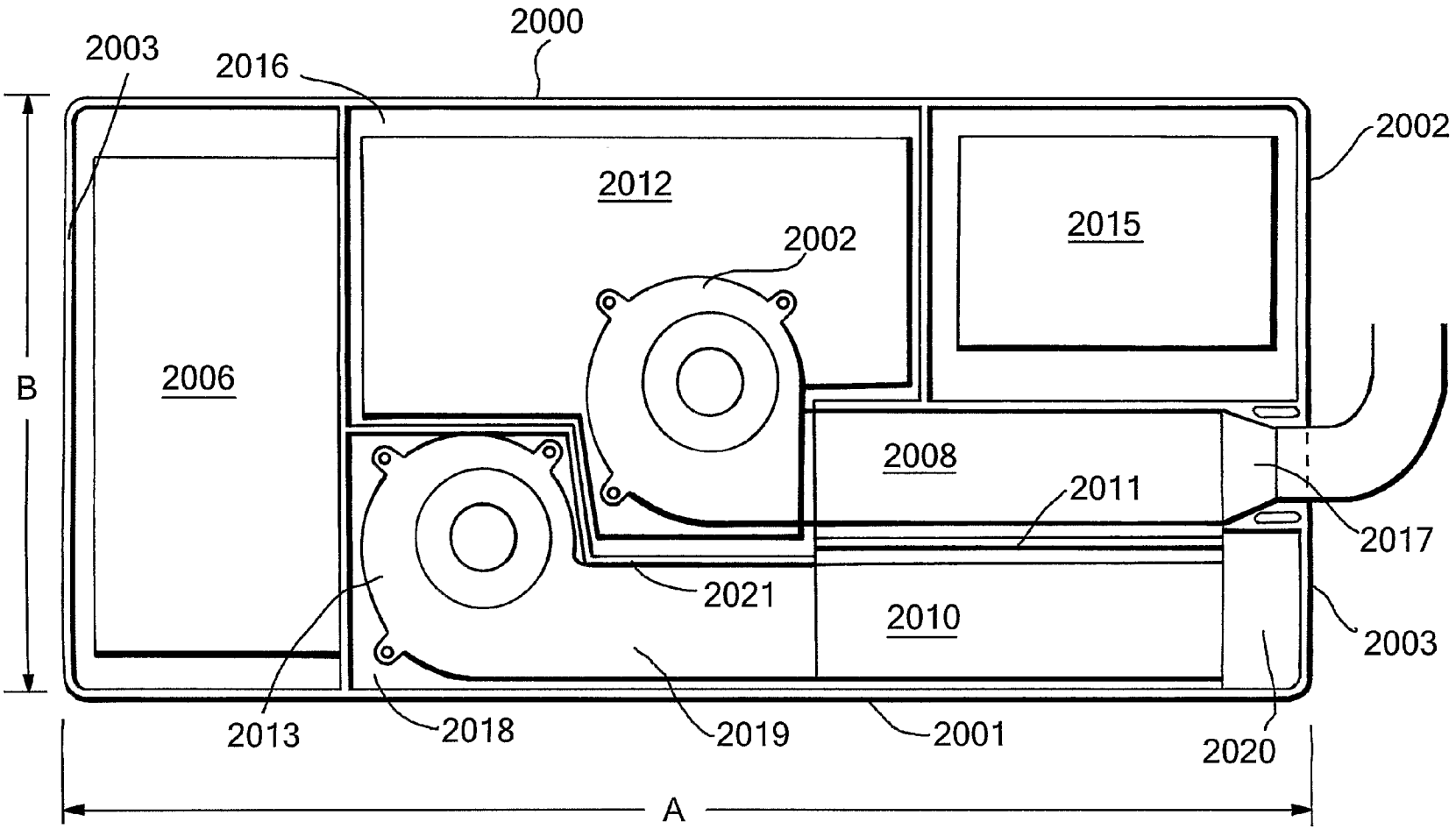
FIG. 20 illustrates schematically a third air heating and cooling device according to a third specific embodiment, in cut away side view.

FIG. 20 illustrates schematically a third air heating and cooling device according to a third specific embodiment, in cut away side view.

Figure 21:
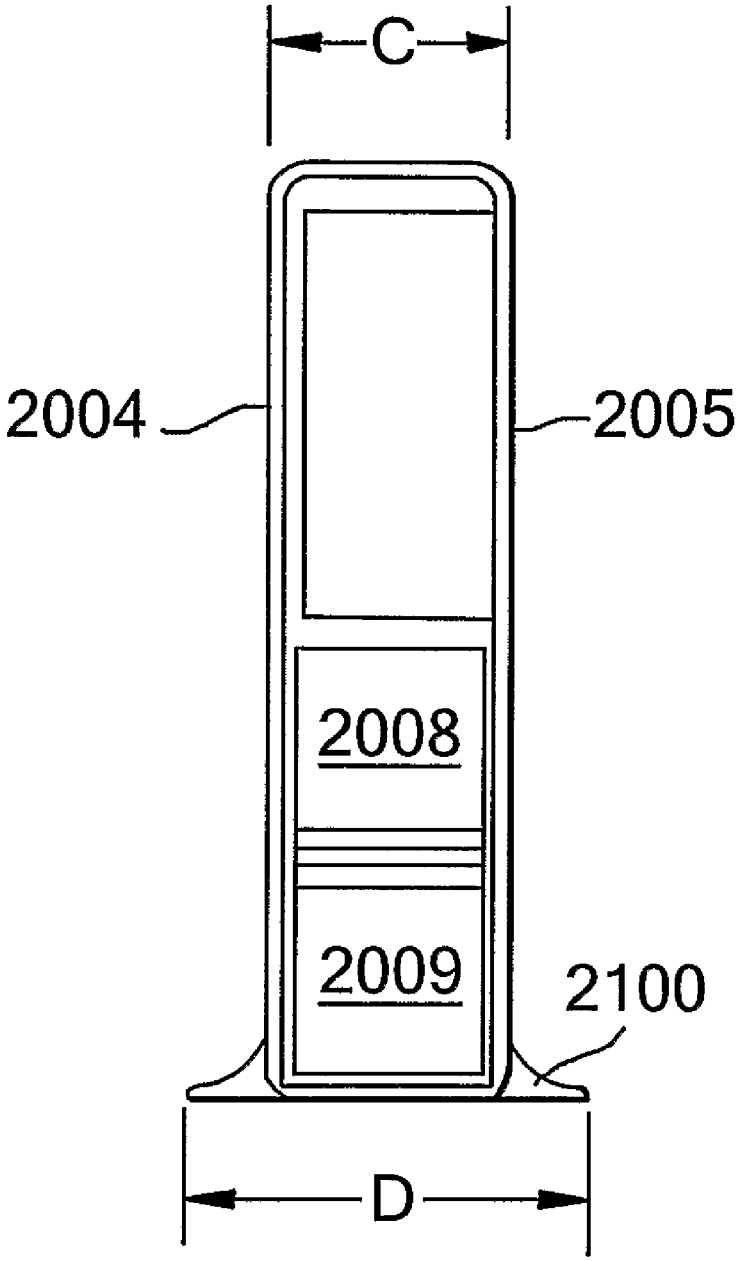
FIG. 21 illustrates schematically the third air heating and cooling device in end view, in an upright orientation.

FIG. 21 illustrates schematically the third air heating and cooling device in end view.

In the third heating and cooling device, the main difference compared to the first and second devices are the overall proportions of the device and the amended layout which allows use of the device in a more restricted space. The third heating and cooling device may be stood end on, in the form of a floor standing "tower" device, or can be laid flat underneath a bed. The device has an outer casing in the form of a substantially flat rectangular "brick" shape. The device has first and second sides 2000, 2001, first and second ends 2002, 2003, a top panel 2004 and a bottom panel 2005. The device may be rotated through 90 degrees and stood on its side, so the top and the bottom panels become the sides in that orientation. In the orientation shown on FIG. 20, the device is viewed from above.

The device may have dimensions of length (A) in the range 500 to 560 mm, and preferably around 540 mm; width (B) in the range 200 to 300 mm and preferably of the order of 80 mm; and height (C) in the range 50 to 70 mm.

The proportions of the device allow its use in a restricted space, for example underneath a bed. The device can be laid flat under a bed, with an air intake on the top 2004 of the device, and air outlets at one end 2002 of the device.

As shown in FIG. 20, in view from above when laid flat, the device comprises the following internal components:

a switch mode power supply 2006;

a primary heat exchanger fan 2007 for drawing air in from a top duct aperture, and pushing air through a first heat sink device 2008 in an air conditioning channel;

a heat exchanger device 2009 comprising the first heat sink 2008, and a second heat sink 2010, and a plurality of Peltier effect devices 2011;

an air filter unit 2012 for filtering input air to the air temperature conditioning channel;

a waste heat fan 2013 for drawing air in through a side vent and forcing air through a waste heat channel 2014; and an electronic control device 2015 for controlling the power supply, filter unit, first fan 2007, second fan 2013 and heat exchanger. On the top panel 2004, air inlet apertures are provided to allow air intake to the primary heat fan and a waste heat fan.

A first air channel, for heating and cooling air comprises a first chamber 2016, open to the air at one side, where the apertures are, the first chamber containing the air filter 2012 and first fan 2007, and an air passage through the first heat sink 2008 of the heat exchanger, terminating in an outlet 2017, which connects to an air supply tube to an air mattress device.

A second air channel, for waste air comprises a second chamber 2018 which is open to the air via a plurality of inlet apertures, and containing the second fan 2013, the second fan channeling air through a passage 2019 which leads to a second heat sink 2010 of the heat exchanger, and through an exhaust vent 2020.

The air filter 2012 may be accessible by a removable cover on the top panel 2004, or by a removable cover elsewhere on the device. The air filter may be shaped so as to fit around the inlet fan. The air filter may be disposable, and replaceable when contaminated. The purpose of the air filter is to remove airborne contaminates such as solid particles, dust, pollen, mould, and bacteria from the air. A range of filter materials may be used including paper, foam, synthetic plastics or natural fibers such as cotton. Cotton air filters may be used because of their durability and good air flow properties. Examples of synthetic materials which may be used for replaceable air filters include polyester fiber. Alternatively, spun fiber filters may be used.

For allergy sufferers, an allergy resistant filter such as a micro-fiber filter may be used to remove common allergens such as dust, pollen, bacteria or other air born particles. The filter may be provided as a filter cartridge, which can be slotted into a front end of the first air channel, at a position either before or after the inlet fan in the first air flow.

The first and second air channels are separated from each other by a dividing wall 2021, and by the Peltier devices 2011 and the bases of the first and second heat sink devices. Heat is transferred between the first and second air channels by the heat exchanger 2008-2011 by operation of the Peltier devices under control of the electronic control unit 2015 as herein before described.

An additional benefit of the third air heating and cooling device is that the fan for waste heat is more efficient, and is able to bring the cooled air down to between 6 and 8° C. below ambient air temperature.

Preferably, the external dimensions of the first heat exchanger are at the order of 180 mm×47 mm, giving a volume occupied of the order of 0.4 $m^3$. The waste channel heat exchanger has similar external dimensions.

In a heating mode, the first air fan 2007 intakes air through the filter unit 2012, and passes the air through the first heat exchanger 2008, which is heated by the Peltier devices 2011. In this mode, the waste heat fan 2013 is on a low rate of air throughput.

In a cooling mode, the power point of the waste heat fan is increased to increase the air flow through the waste heat channel. In this mode, the waste heat fan may be capable of reducing the input air to 6 to 8° C. below ambient, providing a cooled air stream through the waste heat exchanger. With the Peltier effect devices pumping heat from the first heat exchanger 2008 to the second heat exchanger 2010, this enables cooling of the inlet air in the air conditioning channel relative to ambient.

As shown in FIG. 21, an optional detachable base portion 2100 may be fitted on one side of the heating and cooling device, so that the device can be stood on end, taking up minimal floor space. The base may have a footprint area in the range length 500-560 mm, and width 80-120 mm, and preferably of the order of 100 mm. In this mode, air is inlet through the top (now a side) and is outlet at the first end. Only two faces of the case are used for air inlet and outlet, optimizing the air flow and possible orientations in which the device may be placed.

Figure 22:
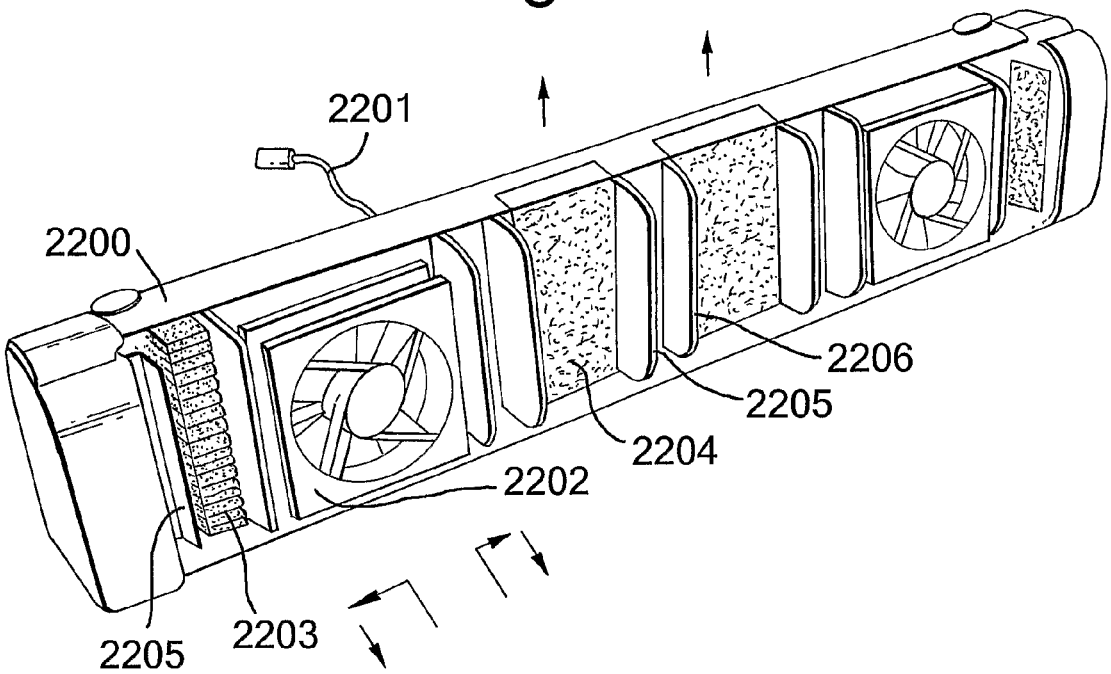
FIG. 22 illustrates schematically in disassembled view a fourth air heating and cooling device according to a fourth specific embodiment.

Referring to FIG. 22 herein, there is illustrated schematically a fourth air heating and cooling device according to a fourth specific embodiment. The device is shown with its front cover removed.

The fourth air heating and cooling device comprises a double unit, capable of providing conditioned air to two air mattresses via two heat conditioning modules in a single device. The device effectively two single air heating and cooling devices placed side by side in a single casing 2200. In FIG. 22, the front of the casing is removed to show internal components. The fourth embodiment heating and cooling device relies on an external power supply, in a separate casing, which may be connected to the fourth heating and cooling device via an electrical cable 2201 which enters the rear of the casing, at a position approximately mid way along the length of the casing.

Each individual air heating and cooling device within the casing comprises a primary heat exchanger axial fan for drawing air through a heat sink device 2203 in an air conditioned air channel; a heat exchanger device comprising a first heat sink 2203 and a second heat sink, the first and second heat sinks being separated by a plurality of heat pump devices, for example Peltier effected devices; an air filter unit 2204 for filtering incoming air to an air temperature conditioning channel within the device; a waste heat fan 2202 for forcing air through a waste heat channel; and an electronic control circuit 2205 for controlling the main fan 2202 and waste heat fan.

The filter 2204 is contained within a filter cartridge, which slides into a slot in the casing and is removable without the need to remove the front of the casing. By pushing an outer face of the filter cartridge, the cartridge, which is resiliently biased and attached to the casing by a catch mechanism, ejects from the cartridge slot, enough to allow a user to grip the end of the cartridge using their fingers and slide the cartridge out of the slot.

The first and second heating and cooling modules are separated within the overall casing by a plurality of bulkheads 2205, 2206 positioned substantially mid way along the length of the device. Airflow paths within the first heating device are fully isolated and separate from the airflow paths within the second device, within the same outer casing.

Since the rear of the casing shown in FIG. 22 has no air inlets or outlets and is formed of a substantially smooth continuous plastics material, the unit can be placed face up on the floor, with the air inlets and outlets facing upwards, thereby enabling the device to occupy a low profile, and possibly to be stored underneath a bed. Alternatively, the device can be placed as shown in FIG. 22, in an upright position, in which the fans draw and expel air in a substantially horizontal direction relative to a floor on which the casing stands.

Figure 23:
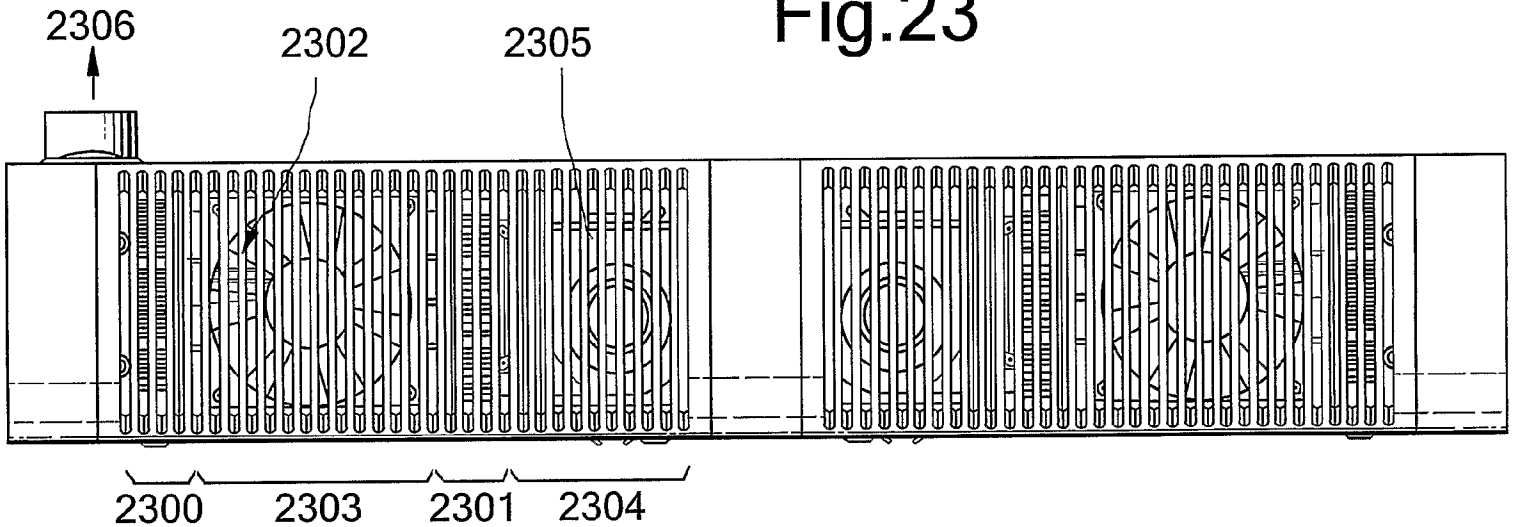
FIG. 23 illustrates schematically the fourth heating and cooling device in view from a front side.

Referring to FIG. 23 herein, there is illustrated schematically the fourth air heating and cooling device of FIG. 22 in view from the front, with the front of the casing in place, showing the inlet and outlet air vents. Waste air is drawn in through a first set of grills 2300, 2301 through a waste heat sink by a first waste air axial fan 2302 and out of a second grill 2303.

Conditioned air is drawn in through a third grill 2304 by a conditioned air channel centrifugal fan 2305 and passes behind the waste fan and waste eat sink, in separate channel at the rear of the device, passing through a second heat sink and out of a conditioned air outlet 2306. Bulkheads in the casing separate the incoming and outgoing waste air.

Figure 24:
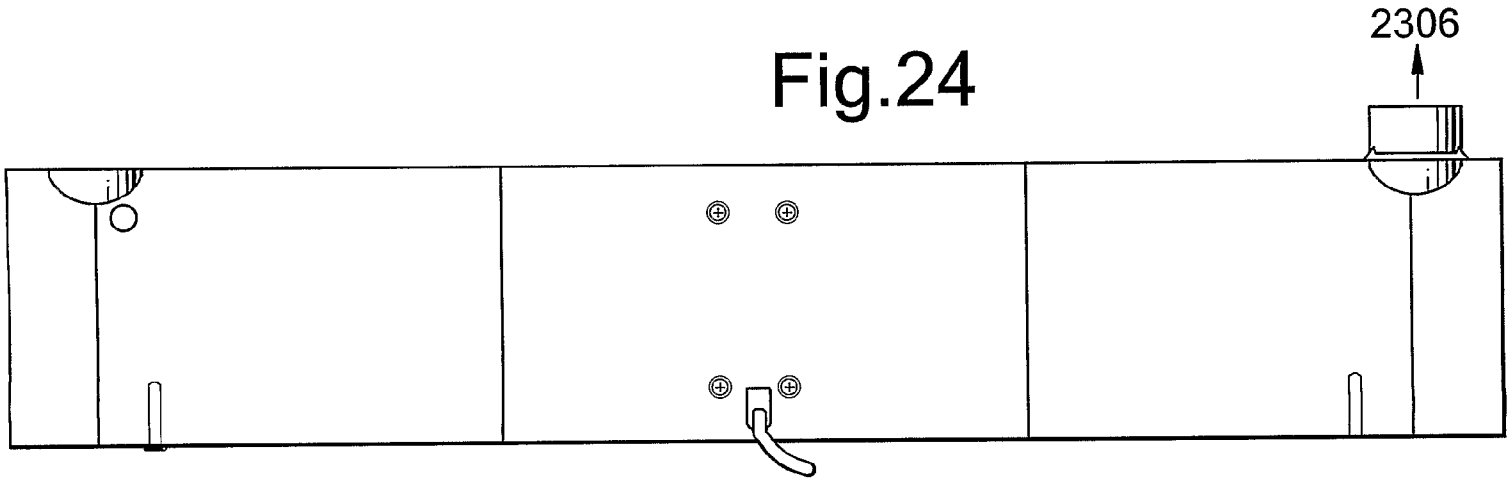
FIG. 24 illustrates schematically the fourth heating and cooling device in view from a rear side.

Referring to FIG. 24 herein, there is illustrated schematically the fourth air heating and cooling device in view from the rear, showing a smooth rear surface suitable for resting the device on a carpet floor or other surface.

Figure 25:
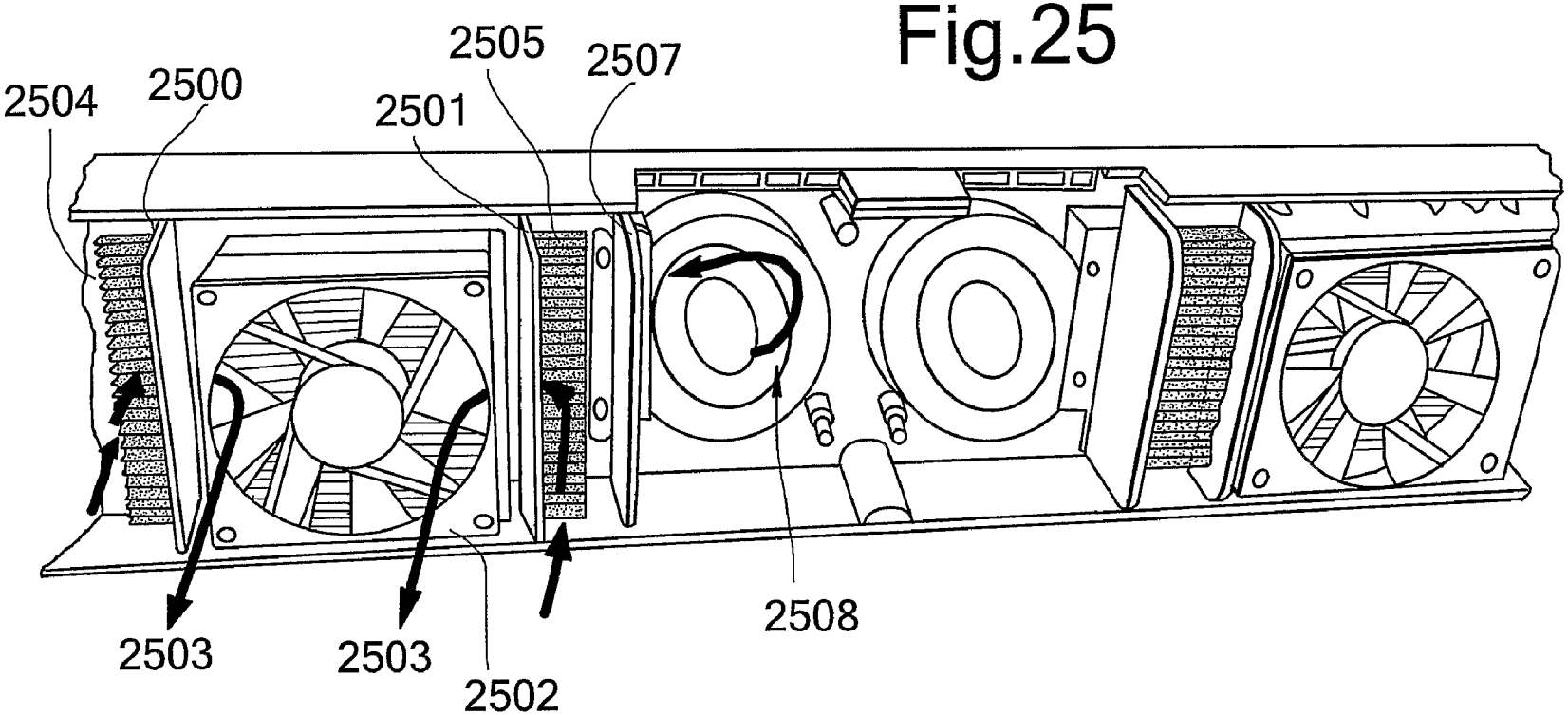
FIG. 25 illustrates schematically the fourth heating and cooling device of FIGS. 22 to 24 in disassembled view form the front, having its filters removed.

Referring to FIG. 25 herein, there is shown in disassembled view the fourth heating and cooling device with the filters removed and showing the air flow paths of the waste/exhaust air cannel and the heated/cooled air supply to the outlet which connect to the mattress. With the device in cooling mode, drawing in air from externally through the grill and into the side chambers at the side of the exhaust fan 2502. The incoming exhaust air channel is contained between first and second dividing bulkheads 2500, 2501 either side of the main exhaust fan and passes into the vanes of one of the outer heat sink of the heat exchanger and out through the main exhaust fan. The air passes along the vanes of the heat exchanger in both directions towards the fan and underneath the bulkheads 2500, 2501 from the adjacent side chambers 2504, 2505 either side of the fan which are open to the outside via grill in the front of the casing. Thus an incoming flow of air 2503 is drawn in to the side chambers, and is then urged in a lateral direction perpendicular to its original direction as it encounters the heat sink of the heat exchanger. The air is then drawn out via the main exhaust fan, out of the second grill area immediately in front of the exhaust fan. The chambers either side of the fan are each defined between a respective pair of bulkheads which extend across the casing, either side of a grill on the front of the casing. The air then exhausts via the second grill openings in the front of the casing. Cool air comes in at the sides of the exhaust fan and warmed air is forced out by the fan.

Of course, the direction of this air flow may be reversed by reversing the direction of rotation of the fan, with similar effect.

In a heating mode, the air flow in the exhaust air channel is similar, or the fan can be turned off or on low speed.

The air flow in the heated or cooled air supply to the mattress is as follows, looking at one heating/cooling unit only. Ambient air is drawn in via an inlet chamber 2508 through an inlet grill in the front of the casing and through a filter (not shown in FIG. 25) into an inlet fan 2509. The inlet fan is enclosed, having an annular inlet in its enclosure for the inlet of air, and channels the air into a passage adjacent the rear casing, which takes the air through the vanes of the other heat sink of the heat exchanger. The air flow passes along the full length of the vanes of the second heat sink so it enters on side of the heat sink and passes the whole way along the heat exchanger until it exits at the other side. Depending on whether the device is in heating mode or cooling mode, the air is either heated in which case heat is taken from the ambient air drawn in the exhaust cannel and transferred to the conditioned air channel, via the Peltier heat pumps transferring heat form the exhaust heat sink to the main heating/cooling heat sink, or if the device is in cooling mode, the Peltier devices transfer heat from the conditioned air to the exhaust air, in which case the exhaust air leaves the device at a higher temperature than it enters, since it carries waste heat. The chamber at the other side of the heat sink, is connected to the conditioned air outlet of the device for supply to the mattress via a supply tube.

Each of the separate modules in the double module device of FIGS. 22 to 25 can be independently controlled so that one module can be operated in heating mode which the other module is operated in a cooling mode, or vice versa, or both modules can be operated in the same mode, e.g. both cooling or both heating. Since each module is independently controllable, the extent of heating or cooling in each module is independent from the other.

Figure 26:
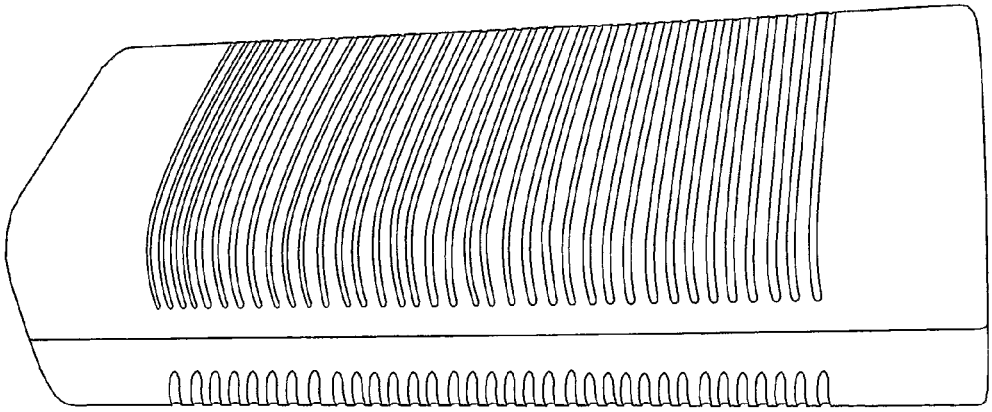
FIG. 26 illustrates schematically a power supply unit for the fourth heating and cooling device of FIGS. 22 to 25, in perspective view from above and one side.

Referring to FIG. 26 herein, there is illustrated schematically a power supply unit for the fourth heating and cooling device. The power supply comprises an interference suppressed transformer which converts mains voltage power to a lower voltage, e.g. 48 volts, which is safer for use in the heating and cooling device. In a best mode the power supply is of dimensions in the range:

Width: 110 mm to 130 mm, and preferably 120 mm

Height: 150 mm to 170 mm, and preferably 160 mm

Length: 810 mm to 840 mm and preferably 830 mm.

The power supply is intended to be positioned away from the heating and cooling device and at a safe position away from any potentially combustible material such as bedding or blankets.

Figure 27:
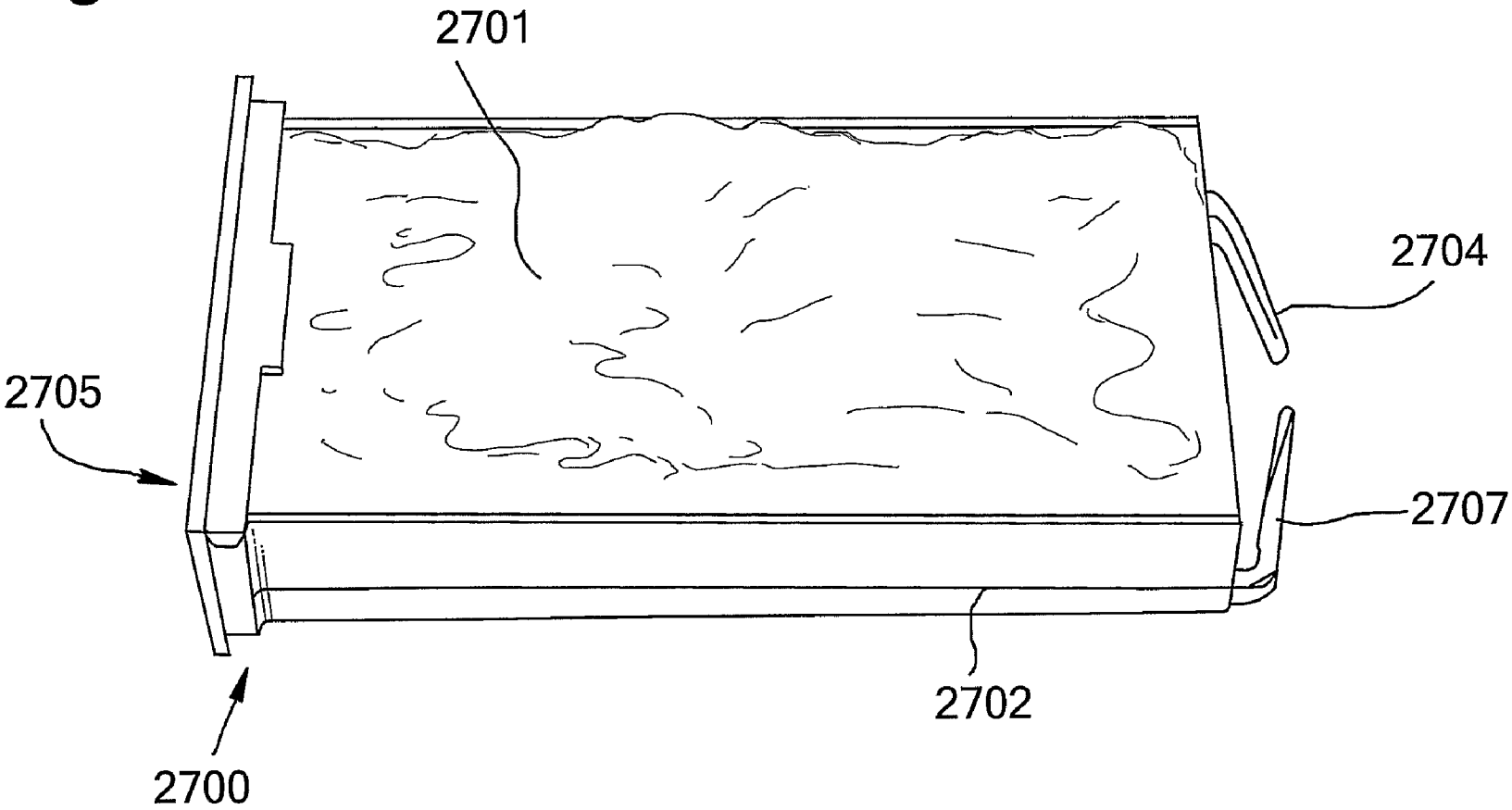
FIG. 27 illustrates schematically a filter of the fourth heating and cooling device.

Referring to FIG. 27 herein, there is illustrated schematically a removable filter device for the fourth embodiment heating and cooling device. The filter device comprises a filter cartridge body 2700 which contains a removable filter 2701. The cartridge slides into and out of a corresponding receiving channel in the casing and locates there by a set of grooves 2702 on the sides of the cartridge. At the base of the cartridge is provided a spring mechanism 2703, 2704 in the form of a pair of resilient fingers, which in use urge against the casing so the when the cartridge is pushed on its outer face 2705, it locks in to the casing and when pushed again it springs out of the casing, urged by the resilient biasing means 2703, 2704. A catch positioned on the casing at the receiving slot for the filter allows the cartridge to engage and lock into the slot or spring out of the slot.

The filter is removable and replaceable by detaching the cartridge from the device. A range of allergenic or non allergenic filters may be substituted in the filter cartridge.

Figure 28:
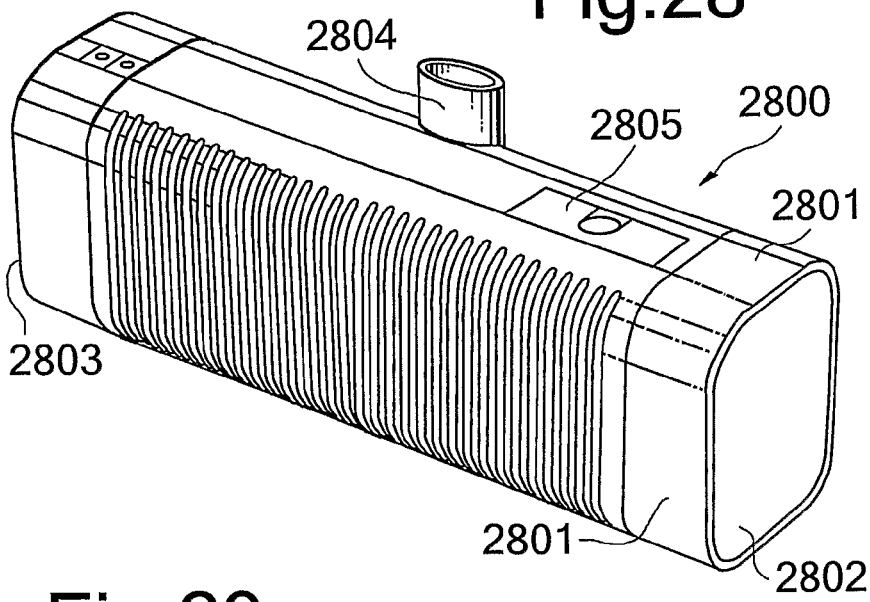
FIG. 28 illustrates schematically a fifth heating and cooling device according to a fifth specific embodiment.

Referring to FIG. 28 herein there is illustrated schematically a fifth heating and cooling device according to a fifth specific embodiment. The fifth heating/cooling device comprises an outer casing 2800 of a substantially tubular rectangular cross section having rounded edges, with a front side 2801, a rear side, an upper side 2801 and a lower side, and first and second ends 2802, 2803. An air outlet 2804 is provided approximately mid way along a length of the device for supplying air to a mattress as described herein before.

The fifth device comprises all of the components described with respect to the fourth embodiment herein, except that only components for one air outlet are present.

Within the casing 2800 are provided a primary heat exchanger fan for pushing air through a heat sink device in an air conditioning channel; a heat exchanger device comprising a first heat sink and a second heat sink, the first and second heat sinks being separated by a plurality of heat pump devices, for example Peltier effected devices; an air filter unit for filtering incoming air to an air temperature conditioning channel within the device; a waste heat fan for forcing air through a waste heat channel; and an electronic control circuit for controlling the main fan and a waste heat fan.

A filter is contained within a spring loaded removable filter cartridge 2805, which slides into a slot in the casing and is removable without the need to remove the front or rear of the casing. By pushing an outer face of the filter cartridge, the cartridge, which is resiliently biased and attached to the casing by a catch mechanism, ejects from the cartridge slot, enough to allow a user to grip the end of the cartridge using their fingers and slide the cartridge out of the slot. The filter cartridge may be removed when the device is positioned upright as shown or when the device is laid on its rear side. In either case the cartridge is positioned in the casing such that it is freely accessible buy a user without the need to lift the device.

Dimensions of the casing, in the best mode may be in the following ranges:

Width: 110 mm to 130 mm, and preferably 120 mm

Height: 150 mm to 170 mm, and preferably 160 mm

Length: 120 mm to 160 mm, and preferably 440 mm

The device is powered by a separate power supply unit, which can be placed away from the heating and cooling device so that the device can be made more compact and lightweight. The device may be positioned in use, as shown in FIG. 28, standing on its lower side, so that the air inlets for the main fan are positioned on the front side of the device, drawing air in horizontally, or alternatively the device may be laid on its rear side so that air intakes for the main fan are facing upwardly.

Figure 29:
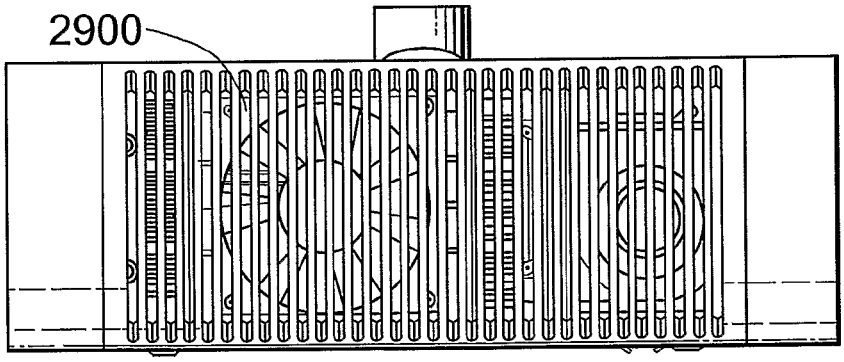
FIG. 29 illustrates schematically the fifth heating and cooling device in view from the front.

Referring to FIG. 29 herein there is illustrated the fifth heating and cooling device in view from the front. A primary heat exchanger fan 3000 is seen visible through an inlet/outlet grill 2901 comprising the front of the casing.

Figure 30:
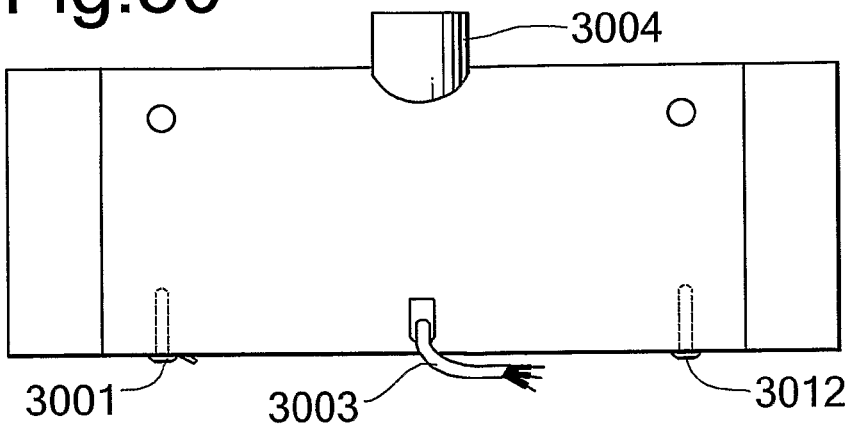
FIG. 30 illustrates schematically the fifth heating and cooling device in view from behind.

Referring to FIG. 30 herein, there is illustrated schematically the rear of the fifth heating and cooling device shown in FIGS. 28 and 29. On the rear face, there are no air inlets or outlets. There are provided a pair of protrusions 3001, 3002 which serve prevent the device from tipping over from its upright position as shown to a (aid down position with the air intakes facing upwards. A power supply lead 3003 enters the casing at a mid position of the casing. The air outlet to a mattress device is positioned between the rear face and the upper face, at a position that the air outlet does not protrude above the main plane of the rear face. This enables the air outlet to lie flat when the device is rested on its rear side.

Figure 31:
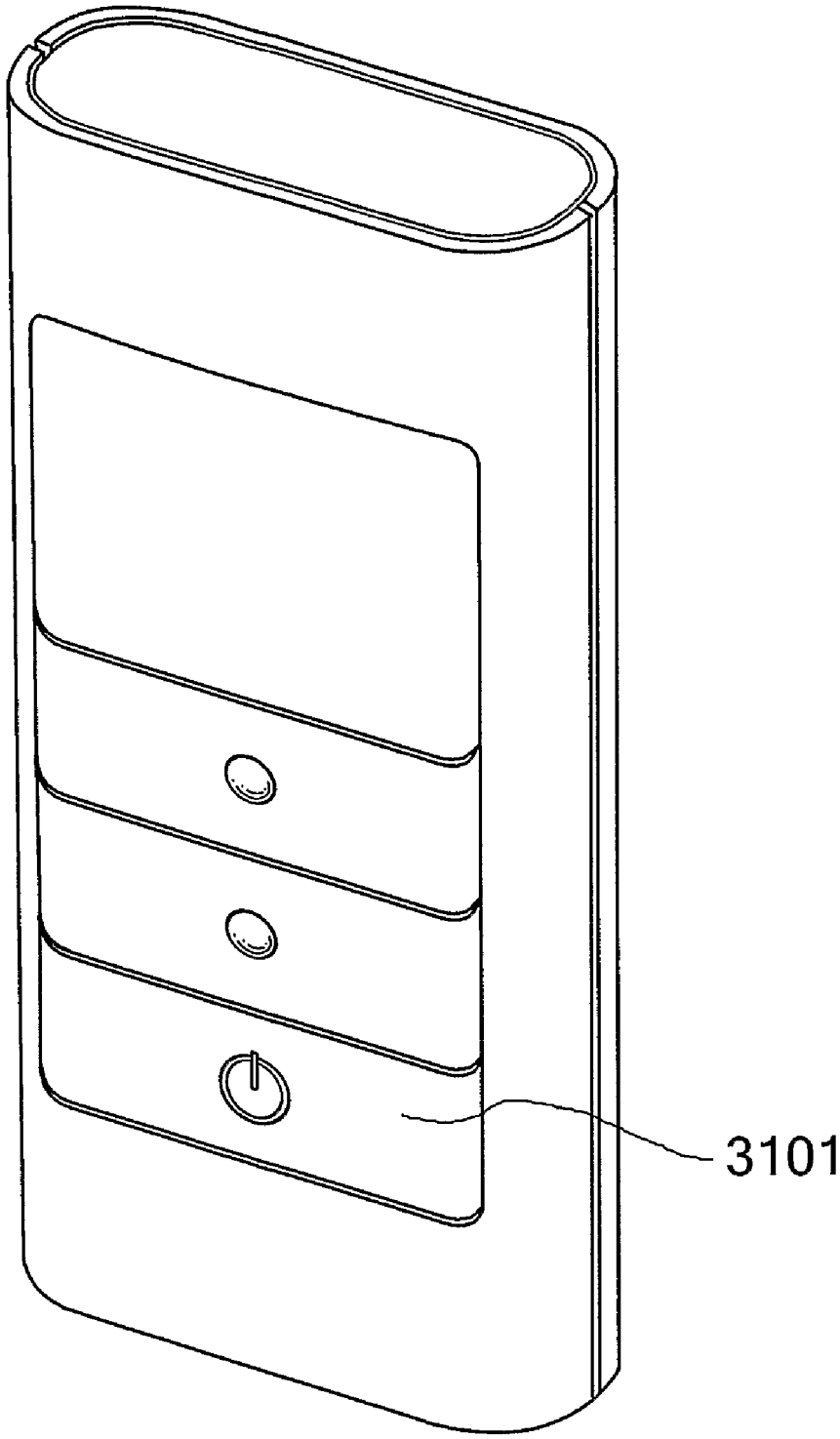
FIG. 31 illustrates schematically a remote control device for controlling the fourth and/or fifth heating and cooling devices.

Referring to FIG. 31 herein, there is illustrated schematically a remote control device 3100 for controlling the fourth and/or fifth heating and cooling devices of FIGS. 22 to 30 herein. The remote control device comprises a power on control 3101 for powering up or powering down the device to turn it on or off, a temperature increase control 3102 for increasing the temperature of air output by the heating/cooling device, and a temperature down device for decreasing the temperature of air output by the heating/cooling device. The remote device can select either one of the two modules to control this independently in the case of a double unit as shown in FIGS. 22 to 25.

In various embodiments the cooling device may be provided with one or more flexible and extendible hoses to connect the temperature conditioned air outlets with the air mattress air inlets, so that the device can be placed adjacent a bed, or underneath the bed. The hose may have and extension portion to enable the casing of the heating and cooling device to be placed lying down with the ambient air inlets and outlets face up, or alternatively facing horizontally, with the temperature conditioned air outlets to the mattress being on an opposite face of the casing substantially perpendicular, or at least transverse, to the face having the plurality of air inlets and outlets for ambient and exhaust air.

The invention claimed is:

1. A device for temperature conditioning an air supply for an air conditioned appliance, said device comprising:

a first air passage for channeling a first air flow;

a second air passage for channeling a second air flow;

an inlet fan for drawing air into said first, air passage;

an exhaust fan for drawing air through said second air passage; and one or a plurality of heat exchangers for exchanging heat between air in said first air passage and air in said second exhaust air passage;

said first air passage comprising a tubular channel having an inlet at a first end and an outlet, said outlet being at a second end of said first air passage, and said inlet fan is positioned at said inlet, such that said first air flow is channeled through said inlet fan, along the whole of said first air passage, encountering all of said one or plurality of heat exchangers and out of said outlet;

said second air passage comprising a tubular wall having at least one inlet and an outlet positioned in said tubular wall;

said one or a plurality of heat exchangers are positioned within said tubular wall, so that said second air flow passes over said one or plurality of heat exchangers; and said exhaust fan is positioned at said outlet such as to draw air through said inlet of said second air passage, over said one or plurality of heat exchangers, and out of said outlet;

wherein the inlet of the first air passage and outlet of the second air passage are located on a same face of the device.

2. The device as claimed in claim 1 wherein the inlet of the second air passage is located on the same face as said inlet of said first air passage and said outlet of said second air passage.

3. The device as claimed in claim 1, comprising a removable and replaceable inlet air filter for filtering air entering said first air passage.

4. The device as claimed in claim 2, wherein said replaceable filter comprises a filter material suitable for removing allergens from said first air flow.

5. The device as claimed in claim 1, wherein said exhaust fan is positioned at an outlet of said second passage way, so as to draw air through one or more inlets of said second passage way, and through said outlet of said second passage way.

6. The device as claimed in claim 1, wherein a said heat exchanger comprises:

a first heat sink extending into said first air passage, such that air flowing through said first air passage exchanges heat with said first heat sink;

a second heat sink extending into said second air passage, such that air flowing in said second air passage exchanges heat with said second heat sink; and one or a plurality of electrically driven Peltier effect heat pump devices, positioned between said first and second heat sinks, said Peltier effect devices capable of pumping heat in a first direction from said first heat sink to said second heat sink in a cooling mode, for cooling air in said first passage, and capable of pumping heat from said second heat sink to said first heat sink for heating said air in said first passage, in a heating mode.

7. The device as claimed in claim 1, wherein said heat exchanger device comprises:

a first set of heat sink devices positioned in said first air passage;

a second set of heat sink devices positioned in said second air passage; and one or a plurality of electric heat pump devices positioned between said first and second heat sinks for transferring heat between said first and second sets of heat sinks.

8. The device as claimed in claim 6, wherein a said heat pump device comprises one or a plurality of Peltier effect devices.

9. The device as claimed in claim 1 for supplying temperature conditioned air to an air mattress having a plurality of air passages designed for flow of air there through.

10. The device as claimed in claim 1, capable of supplying temperature conditioned air to a double divan size air mattress such that upon initiating a heating mode, a temperature at a surface of said air mattress increases over a five to fifteen degrees centigrade range over a period of 12 minutes.

11. The device as claimed in claim 1, capable of supplying temperature conditioned air to a double divan size air mattress such that in a cooling mode, a surface temperature of said air mattress reaches a temperature of between two and four degrees below ambient external air temperature.

12. The device as claimed in claim 1, capable of supplying temperature conditioned air to a double divan size air mattress such that in a cooling mode, after a five hour period from initiating said cooling mode, an air temperature of said air mattress is in the range of between two and three degrees below ambient external air temperature.

13. The device as claimed in claim 1, having overall external dimensions in the ranges:

width 15 cm to 36 cm height 7 cm to 15 cm length 20 cm to 40 cm.

14. The device as claimed in claim 1, wherein said first air passage has an internal cross sectional area in a direction perpendicular to a main direction of air flow, in the range 30 $cm^2$, to 120 $cm^2$.

15. The device as claimed in claim 1, wherein said second air passage has an internal cross sectional area in a direction perpendicular to a main direction of air flow, in the range 30 $cm^2$, to 108 $cm^2$.

16. The device as claimed in claim 1, wherein a said heat exchanger comprises:

an upper heat sink comprising a plurality of fins extending parallel to a main direction of airflow in said first passage; and a second heat sink comprising a plurality of elongate fins extending parallel to a main direction of airflow in said second air passage;

four Peltier effect heat pump devices, each having an active upper surface area in the range 625 $mm^2$ to 2025 $mm^2$, and having a second active area of dimensions in the range 625 $mm^2$ to 1600 $mm^2$.

17. The device as claimed in claim 1, in combination with an air mattress, said air mattress comprising a plurality of fibres forming a plurality of generally parallel tubes arranged side by side, said plurality of fibres having air gaps there between, for allowing exit of air passing through said plurality of tubes, such that said air is released over substantially a whole upper surface of said air mattress.

* * * * *

UNITED STATES PATENT AND TRADEMARK OFFICE

CERTIFICATE OF CORRECTION

PATENT NO. : 7,908,687 B2
APPLICATION NO. : 12/224081
DATED : March 22, 2011
INVENTOR(S) : Ward et al.

It is certified that error appears in the above-identified patent and that said Letters Patent is hereby corrected as shown below:

In column 20, line 4, claim 8, “in claim 6” should read -- in claim 7 --

Signed and Sealed this
Fourteenth Day of June, 2011

David J. Kappos

David J. Kappos
*Director of the United States Patent and Trademark Office*